US011591769B2

(12) United States Patent
Chiba et al.

(10) Patent No.: US 11,591,769 B2
(45) Date of Patent: Feb. 28, 2023

(54) WORK MACHINE

(71) Applicant: HITACHI CONSTRUCTION MACHINERY CO., LTD., Tokyo (JP)

(72) Inventors: Takaaki Chiba, Kasumigaura (JP); Hiroaki Tanaka, Kasumigaura (JP); Hisami Nakano, Tsuchiura (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 190 days.

(21) Appl. No.: 16/981,555

(22) PCT Filed: Jun. 6, 2019

(86) PCT No.: PCT/JP2019/022624
§ 371 (c)(1),
(2) Date: Sep. 16, 2020

(87) PCT Pub. No.: WO2020/044711
PCT Pub. Date: Mar. 5, 2020

(65) Prior Publication Data

US 2021/0062460 A1 Mar. 4, 2021

(30) Foreign Application Priority Data

Aug. 30, 2018 (JP) ..... JP2018-162052

(51) Int. Cl.
*E02F 3/43* (2006.01)
*E02F 3/32* (2006.01)
(Continued)

(52) U.S. Cl.
CPC ..... *E02F 3/435* (2013.01); *E02F 3/32* (2013.01); *E02F 9/2004* (2013.01);
(Continued)

(58) Field of Classification Search
CPC . E02F 3/32; E02F 3/435; E02F 9/2285; E02F 9/2025; E02F 9/2203
See application file for complete search history.

(56) References Cited

U.S. PATENT DOCUMENTS 5,218,897 A * 6/1993 Shirai ..... F15B 11/024 137/596.13
2017/0247861 A1 8/2017 Matsuya et al.
2017/0268198 A1* 9/2017 Shimano ..... E02F 3/32

FOREIGN PATENT DOCUMENTS

EP 0785312 A1 7/1997
JP 07-197489 A 8/1995
(Continued)

OTHER PUBLICATIONS

International Preliminary Report on Patentability received in corresponding International Application No. PCT/JP2019/022624 dated Mar. 11, 2021.
(Continued)

*Primary Examiner* — Abiy Teka
(74) *Attorney, Agent, or Firm* — Mattingly & Malur, PC

(57) ABSTRACT

A controller mounted in a work machine limits a velocity at which a work device approaches a design surface to be equal to or lower than a predetermined limiting velocity in such a manner that the work machine is located above the design surface when an operation device is operated. The controller determines whether a work phase of the work device is compaction work on the basis of a posture of a bucket with respect to the design surface in a case in which the operation device instructs the work device to approach the design surface, and sets the limiting velocity when determining that the work phase of the work device is the compaction work to be higher than the limiting velocity when determining that the work phase of the work device is other than the compaction work.

10 Claims, 19 Drawing Sheets

(51) Int. Cl.
*E02F 9/20* (2006.01)
*E02F 9/22* (2006.01)

(52) U.S. Cl.
CPC ..... *E02F 9/2025* (2013.01); *E02F 9/2271* (2013.01); *E02F 9/2203* (2013.01); *E02F 9/2285* (2013.01); *E02F 9/2292* (2013.01); *E02F 9/2296* (2013.01)

(56) References Cited

FOREIGN PATENT DOCUMENTS

| | | | |
|---|---|---|---|
| JP | 08-105077 | A | 4/1996 |
| JP | 2016-098535 | A | 5/2016 |
| JP | 2019-060109 | A | 4/2019 |
| WO | 2016/111384 | A1 | 7/2016 |
| WO | 2016/133225 | A1 | 8/2016 |
| WO | 2019/049309 | A1 | 3/2019 |

OTHER PUBLICATIONS

International Search Report of PCT/JP2019/022624 dated Aug. 20, 2019.

* cited by examiner

WORK MACHINE

TECHNICAL FIELD

The present invention relates to a work machine.

BACKGROUND ART

It is known that a hydraulic excavator, which is one type of a work machine, has a region limiting function to control a multijoint front work device (often simply referred to as a work device) in such a manner as to prevent penetration of a control point (for example, bucket claw tip) of the work device into a design surface.

Such a region limiting function can keep the control point of the work device onto the design surface by setting a velocity at which the work device moves toward the design surface to be lower as a distance between the control point of the work device and the design surface is smaller, and setting to zero the velocity at which the work device moves toward the design surface when the distance between the control point of the work device and the design surface is zero.

However, in actual work, not only finishing work for moving the control point (bucket claw tip) along the design surface to form a flat surface but also compaction work such as bumping for pushing a back surface of a bucket against a ground and compacting earth and sand by a boom lowering action is often necessary. Owing to this, if the velocity in a direction of the design surface is set lower near the design surface by the region limiting function described above on a scene where the compaction work is necessary, problems occur that a force of pushing the back surface of the bucket against the ground weakens and that it is impossible to conduct operator's intended work or an operator has a feeling of strangeness for an operation.

In Patent Document 1, for example, it is determined that a work phase is compaction work in a case in which a ratio (a1/A1) of a low-pass filtered boom operation signal (a1) to an actual boom operation signal (A1) is lower than a constant (r1) smaller than 1. In addition, Patent Document 1 discloses that favorable compaction work can be conducted by setting to be higher a limiting velocity of the work device or cancelling limitations when it is determined that the work phase is compaction work, compared with work other than the compaction work.

PRIOR ART DOCUMENT

Patent Document

Patent Document 1: PCT Patent Publication No. WO2016/133225

SUMMARY OF THE INVENTION

Problem to be Solved by the Invention

However, with a technology of Patent Document 1, it is determined whether the work phase is the compaction work only by the boom operation signal. Owing to this, if the boom operation signal satisfies the condition described above, there is a probability that the work phase is determined to be the compaction work and the velocity limitation (that is, region limiting function) on the work device is either relaxed or cancelled even in a state, for example, in which an angle formed between the bucket back surface and the design surface is a right angle and the bucket claw tip stands upright on the design surface. If the velocity limitation on the work device is relaxed or cancelled in this state, the bucket claw tip penetrates into below the design surface and an actual surface to be worked is damaged against an operator's intention of work.

An object of the present invention is to provide a work machine capable of accurately determining a work phase and favorably conducting compaction work.

Means for Solving the Problem

To attain the object, a work machine includes: a work device having a boom, an arm, and a bucket; a plurality of hydraulic actuators that drive the work device; an operation device that outputs an operation signal in response to an operator's operation and that instructs the plurality of hydraulic actuators to be actuated; and a controller that limits a velocity at which the work device approaches a predetermined design surface to be equal to or lower than a predetermined limiting velocity in such a manner that the work device is located onto or above the design surface when the operation device is operated, the controller determining whether a work phase of the work device is compaction work on the basis of a posture of the bucket with respect to the design surface in a case in which the operation device instructs the work device to approach the design surface, and setting the limiting velocity when determining that the work phase of the work device is the compaction work to be higher than the limiting velocity when determining that the work phase of the work device is other than the compaction work.

Advantages of the Invention

According to the present invention, it is possible to accurately determine a work phase and favorably conducting compaction work.

BRIEF DESCRIPTION OF THE DRAWINGS

FIG. 2 is an explanatory diagram of a boom angle θ1, an arm angle θ2, a bucket angle θ3, a machine body longitudinal inclination angle θ4, and the like.

MODES FOR CARRYING OUT THE INVENTION

A work machine according to embodiments of the present invention will be described hereinafter with reference to the drawings.

Embodiment 1

Figure 1:
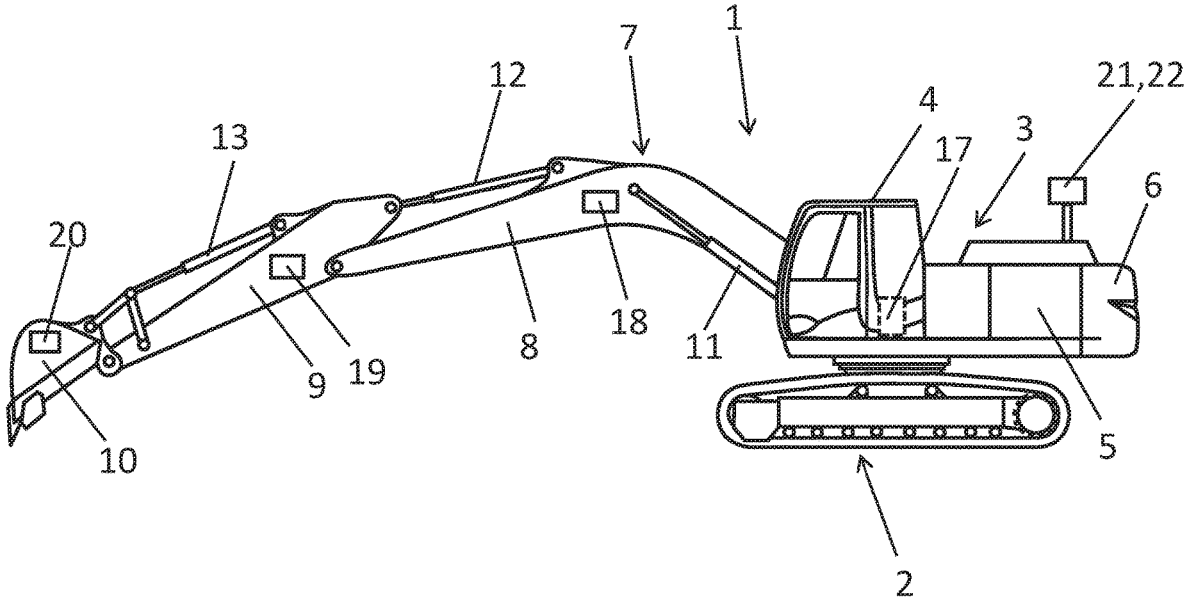
FIG. 1 is a side view of a hydraulic excavator 1 that is one example of a work machine according to embodiments of the present invention.

FIG. 1 is a side view of a hydraulic excavator 1 that is an example of a work machine according to the embodiments of the present invention. The hydraulic excavator 1 is configured with a travel structure (lower travel structure) 2 driven by hydraulic motors (not depicted) provided on respective left and right side portions, and a swing structure (upper swing structure) 3 swingably provided on the travel structure 2.

The swing structure 3 has an operation room 4, a machine room 5, and a counterweight 6. The operation room 4 is provided in a left side portion in a front portion of the swing structure 3. The machine room 5 is provided in rear of the operation room 4. The counterweight is provided in rear of the machine room 5, that is, on a rear end of the swing structure 3.

In addition, the swing structure 3 is equipped with a multijoint work device 7. The work device 7 is provided rightward of the operation room 4 in the front portion of the swing structure 3, that is, in a generally central portion of the front portion of the swing structure 3. The work device 7 has a boom 8, an arm 9, a bucket (work tool) 10, a boom cylinder 11, an arm cylinder 12, and a bucket cylinder 13. A base end portion of the boom 8 is rotatably attached to the front portion of the swing structure 3 via a boom pin P1 (refer to FIG. 2). A base end portion of the arm 9 is rotatably attached to a tip end portion of the boom 8 via an arm pin P2 (refer to FIG. 2). A base end portion of the bucket 10 is rotatably attached to a tip end portion of the arm 9 via a bucket pin P3 (refer to FIG. 2). The boom cylinder 11, the arm cylinder 12, and the bucket cylinder 13 are hydraulic cylinders each driven by a hydraulic operating fluid. The boom cylinder 11 expands or contracts to drive the boom 8, the arm cylinder 12 expands or contracts to drive the arm 9, and the bucket cylinder 13 expands or contracts to drive the bucket 10. It is noted that the boom 8, the arm 9, and the bucket (work tool) 10 are each often referred to as a front member, hereinafter.

A variable displacement first hydraulic pump 14 and a variable displacement second hydraulic pump 15 (refer to FIG. 3), and an engine (prime mover) 16 (refer to FIG. 3) that drives the first hydraulic pump 14 and the second hydraulic pump 15 are installed within the machine room 5.

A machine body inclination sensor 17 is attached to an interior of the operation room 4, a boom inclination sensor 18 is attached to the boom 8, an arm inclination sensor 19 is attached to the arm 9, and a bucket inclination sensor 20 is attached to the bucket 10. The machine body inclination sensor 17, the boom inclination sensor 18, the arm inclination sensor 19, and the bucket inclination sensor 20 are, for example, IMUs (Inertial Measurement Units). The machine body inclination sensor 17 measures an angle (ground angle) of the swing structure (machine body) 3 with respect to a horizontal surface, the boom inclination sensor 18 measures a ground angle of the boom 8 with respect to the horizontal surface, the arm inclination sensor 19 measures a ground angle of the arm 9 with respect to the horizontal surface, and the bucket inclination sensor 20 measures a ground angle of the bucket 10 with respect to the horizontal surface.

A first GNSS (Global Navigation Satellite System) antenna 21 and a second GNSS antenna 22 are attached left and right in a rear portion of the swing structure 3, respectively. Position data about predetermined two points (for example, positions of base end portions of the first GNSS antenna 21 and the second GNSS antenna 22) in a global coordinate system can be calculated from navigation signals received by the antennas 21 and 22 from a plurality of navigation satellites (preferably four or more satellites). In addition, it is possible to calculate coordinate values of an origin P0 (refer to FIG. 2), which is in a local coordinate system (machine body reference coordinate system) set to the hydraulic excavator 1, in the global coordinate system and postures of three axes that configure the local coordinate system (that is, postures and azimuths of the travel structures 2 and the swing structure 3 in an example of FIG. 2) in the global coordinate system, from the calculated position data about (coordinate values of) the two points in the global coordinate system. A controller 25, to be described later, can perform computing processing on various positions based on such navigation signals.

Figure 2:
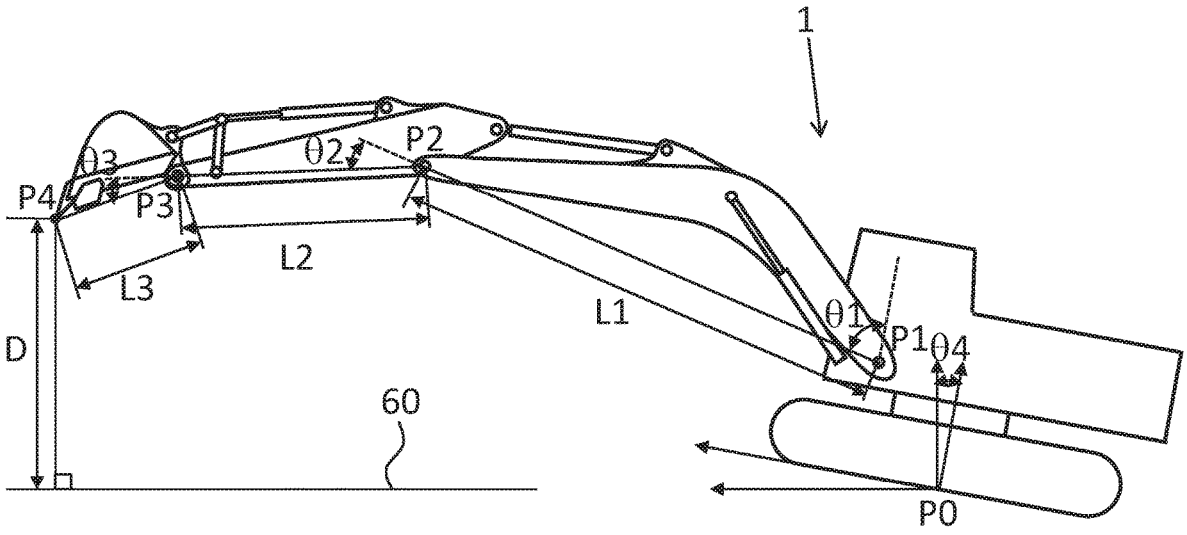

FIG. 2 is a side view of the hydraulic excavator 1. As depicted in FIG. 2, it is assumed that a length of the boom 8, that is, a length from the boom pin P1 to the arm pin P2 is L1. It is also assumed that a length of the arm 9, that is, a length from the arm pin P2 to the bucket pin P3 is L2. It is further assumed that a length of the bucket 10, that is, a length from the bucket pin P3 to a bucket tip end (claw tip of the bucket 10) P4 is L3. Furthermore, it is assumed that an inclination angle of the swing structure 3 with respect to the global coordinate system, that is, an angle formed between a vertical direction of the horizontal surface (direction perpendicular to the horizontal surface) and a machine body vertical direction (direction of a swing central axis of the swing structure 3) is θ4. The inclination angle will be referred to as machine body longitudinal inclination angle θ4, hereinafter. It is assumed that an angle formed between a segment connecting the boom pin P1 to the arm pin P2 and the machine body vertical direction is θ1, and the angle will be referred to as boom angle θ1, hereinafter. It is assumed that an angle formed between a segment connecting the arm pin P2 to the bucket pin P3 and a straight line formed by the boom pin P1 and the arm pin P2 is θ2, and the angle will be referred to as arm angle θ2, hereinafter. It is assumed that a segment connecting the bucket pin P3 to the bucket tip end P4 and a straight line formed by the arm pin P2 and the bucket pin P3 is θ3, and the angle will be referred to as bucket angle θ3, hereinafter.

Figure 3:
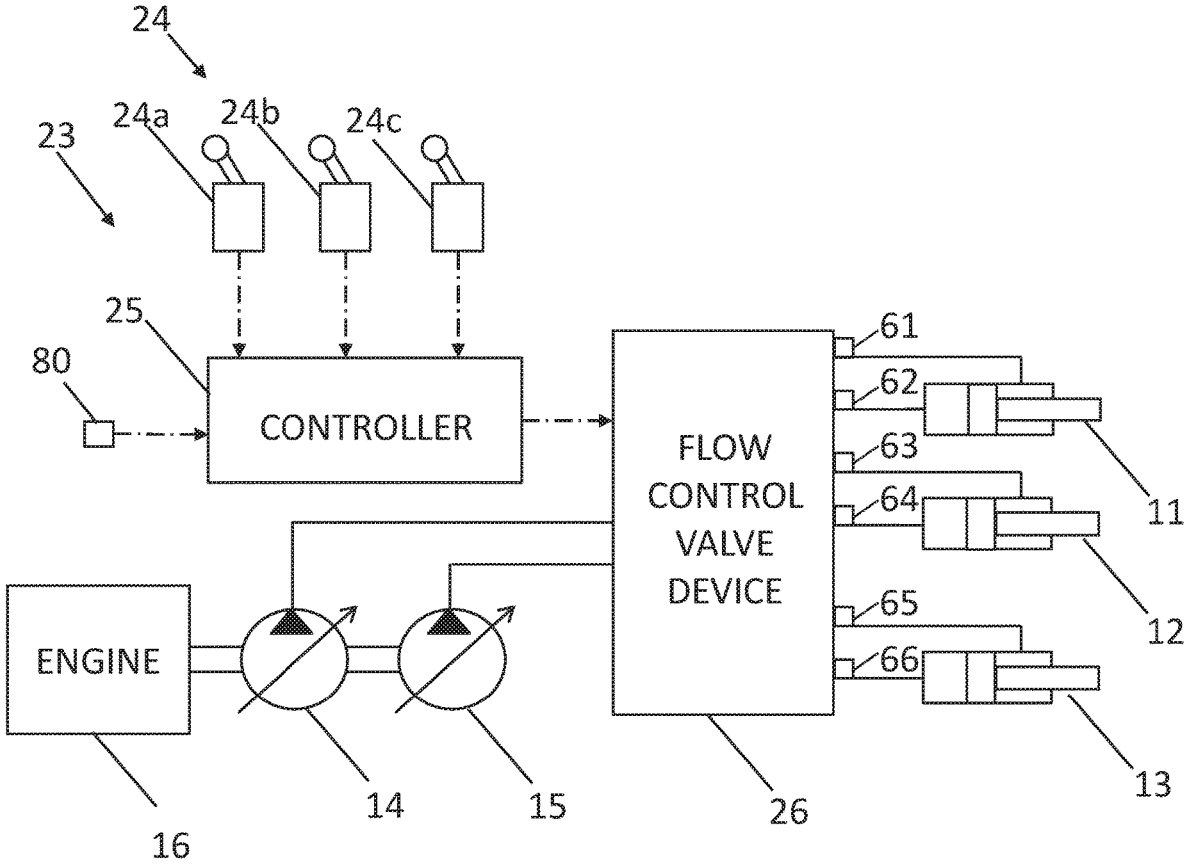
FIG. 3 is a configuration diagram of a machine control system 23 of the hydraulic excavator 1.

FIG. 3 depicts configurations of a machine body control system 23 of the hydraulic excavator 1. The machine body control system 23 is configured with an operation device 24 for operating the work device 7, the engine 16 that drives the first and second hydraulic pumps 14 and 15, a flow control valve device 26 that controls flow rates and directions of hydraulic operating fluids supplied from the first and second hydraulic pumps 14 and 15 to the boom cylinder 11, the arm cylinder 12, and the bucket cylinder 13, and the controller 25 that is a control device controlling the flow control valve device 26.

The operation device 24 has a boom operation lever 24*a* for operating the boom 8 (boom cylinder 11), an arm operation lever 24*b* for operating the arm 9 (arm cylinder 12), and a bucket operation lever 24*c* for operating the bucket 10 (bucket cylinder 13). The operation levers 24*a*, 24*b*, and 24*c* are, for example, electric levers and output voltage values in response to tilting amounts (operation amounts) of the operation levers 24*a*, 24*b*, and 24*c* to the controller 25. The boom operation lever 24*a* outputs a target action amount (hereinafter, referred to as a boom operation amount) of the boom cylinder 11 as the voltage value in response to the operation amount of the boom operation lever 24*a*. The arm operation lever 24*b* outputs a target action amount (hereinafter, referred to as an arm operation amount) of the arm cylinder 12 as the voltage value in response to the operation amount of the arm operation lever 24*b*. The bucket operation lever 24*c* outputs a target action amount (hereinafter, referred to as a bucket operation amount) of the bucket cylinder 13 as the voltage value in response to the bucket operation lever 24*c*. Alternatively, the operation levers 24*a*, 24*b*, and 24*c* may be hydraulic pilot levers and detect the operation amounts by converting pilot pressures generated in response to the tilting amounts of the operation levers 24*a*, 24*b*, and 24*c* into voltage values by a pressure sensor (not depicted) and outputting the voltage values to the controller 25.

The controller 25 computes control commands on the basis of the operation amounts output from the operation device 24, position data (control point position data) about the bucket tip end P4 that is a predetermined control point set to the work device 7 in advance, position data (design surface information) about a design surface 60 (refer to FIG. 2) stored in the controller 25 in advance, and outputs the control commands to the flow control valve device 26. The controller 25 according to the present embodiment computes target velocities of the arm cylinder 12 and the boom cylinder 11 in response to a distance (design surface distance) D (refer to FIG. 2) between the bucket tip end P4 (control point) and the target surface 60 in such a manner that an action range of the work device 7 is limited onto and above the design surface 60 when the operation device 24 is operated. While the bucket tip end P4 (claw tip of the bucket 10) is set as the control point of the work device 7 in the present embodiment, an optional point on the work device 7 can be set as the control point. For example, a point that is a part closer to the tip end than the arm 9 in the work device 7 and that is closest to the design surface 60 may be set as the control point.

A boom rod pressure sensor 61 that acquires a rod pressure of the boom cylinder 11 and a boom bottom pressure sensor 62 that acquires a bottom pressure of the boom cylinder 11 are attached to the boom cylinder 11. An arm rod pressure sensor 63 that acquires a rod pressure of the arm cylinder 12 and an arm bottom pressure sensor 64 that acquires a bottom pressure of the arm cylinder 12 are attached to the arm cylinder 12. A bucket rod pressure sensor 65 that acquires a rod pressure of the bucket cylinder 13 and a bucket bottom pressure sensor 66 that acquires a bottom pressure of the bucket cylinder 13 are attached to the bucket cylinder 13. Detection signals of these pressure sensors 61 to 66 are input to the controller 25.

Figure 4:
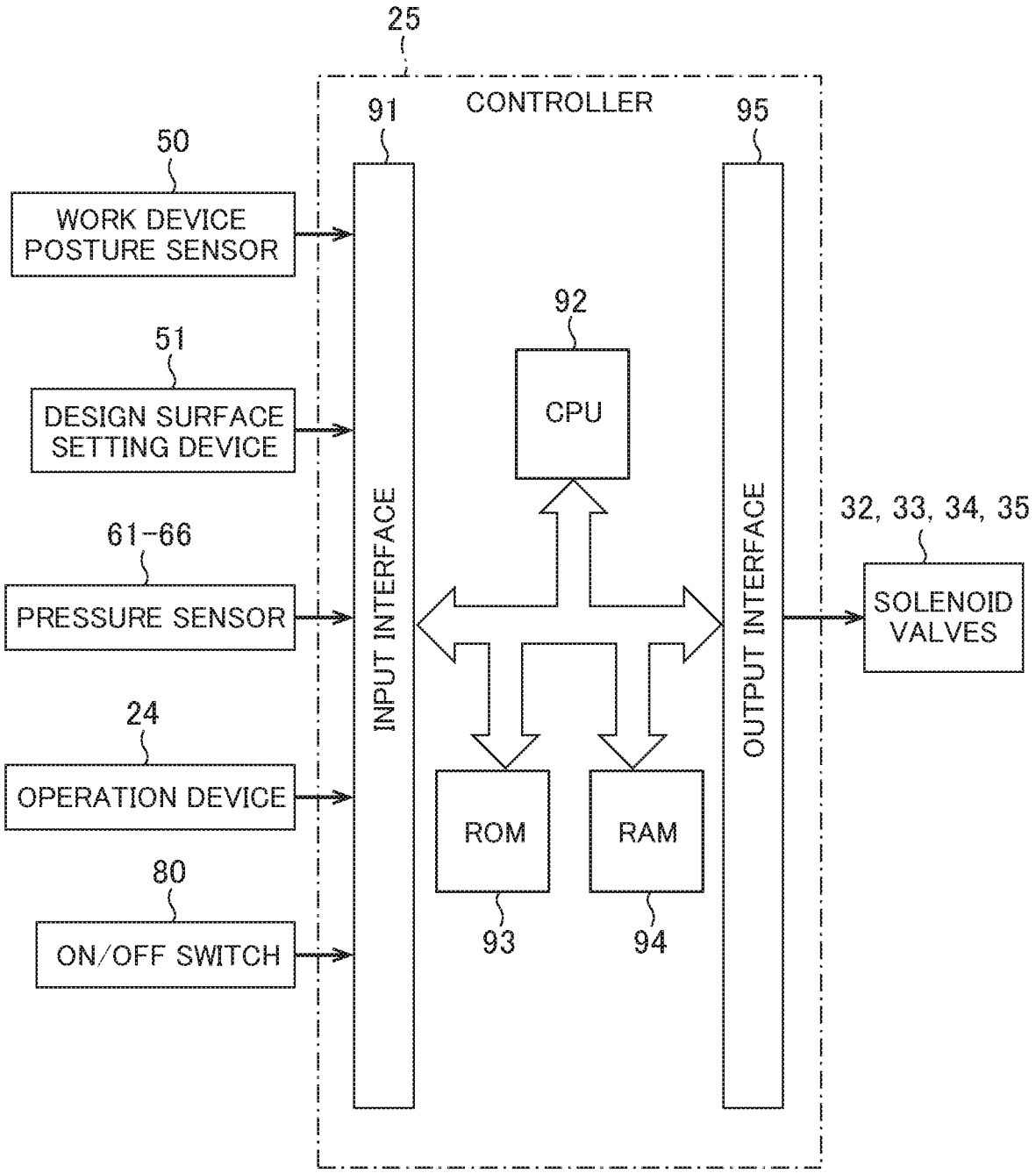
FIG. 4 is a schematic diagram of hardware configurations of a controller 25.

FIG. 4 is a schematic diagram of hardware configurations of the controller 25. In FIG. 4, the controller 25 has an input interface 91, a central processing unit (CPU) 92 that is a processor, a read only memory (ROM) 93 and a random access memory (RAM) 94 that are storage devices, and an output interface 95. Signals from the inclination sensors 17, 18, 19, 20 that serve as a work device posture sensor 50 that detects postures of the work device 7, the voltage values (signals) from the operation device 24 that indicate the operation amounts of the operation levers 24*a*, 24*b*, and 24*c*, a signal from a design surface setting device 51 that is a device for setting the design surface 60 serving as a reference of excavation work and filling work performed by the work device 7, and signals from the pressure sensors 61 to 66 that detect the rod pressures or the bottom pressures of the hydraulic cylinders 11, 12, and 13 are input to the input interface 91, and the input interface 91 converts the signals so that the CPU 92 can perform computing. The ROM 93 is a recording medium in which a control program for the controller 25 to execute various control processing including processing related to a flowchart to be described later, various information necessary for the controller 25 to execute the various control processing, and the like are stored. The CPU 92 performs predetermined computing processing on the signals imported from the input interface 91, the ROM 93, and the RAM 94 in accordance with the control program stored in the ROM 93. The output interface 95 creates signals for output in response to a computing result of the CPU 92 and outputs the signals. The signals for output from the output interface 95 include the control commands given to solenoid valves 32, 33, 34, and 35 (refer to FIG. 5), and the solenoid valves 32, 33, 34, and 35 are actuated on the basis of the control commands and control the hydraulic cylinders 11, 12, and 13. While the controller 25 of FIG. 4 is configured with semiconductor memories that are the ROM 93 and the RAM 94 as the storage devices, the controller 25 may be configured with other devices as an alternative to the ROM 93 and the RAM 93 as long as the devices are storage devices. The controller 25 may be configured with, for example, magnetic storage devices such as hard disk drives.

The flow control valve device 26 is configured with a plurality of electromagnetically driven spools, and drives a plurality of hydraulic actuators mounted in the hydraulic excavator 1 and including the hydraulic cylinders 11, 12, and 13 by changing opening areas (throttle opening degrees) of the spools on the basis of the control commands output from the controller 25.

Figure 5:
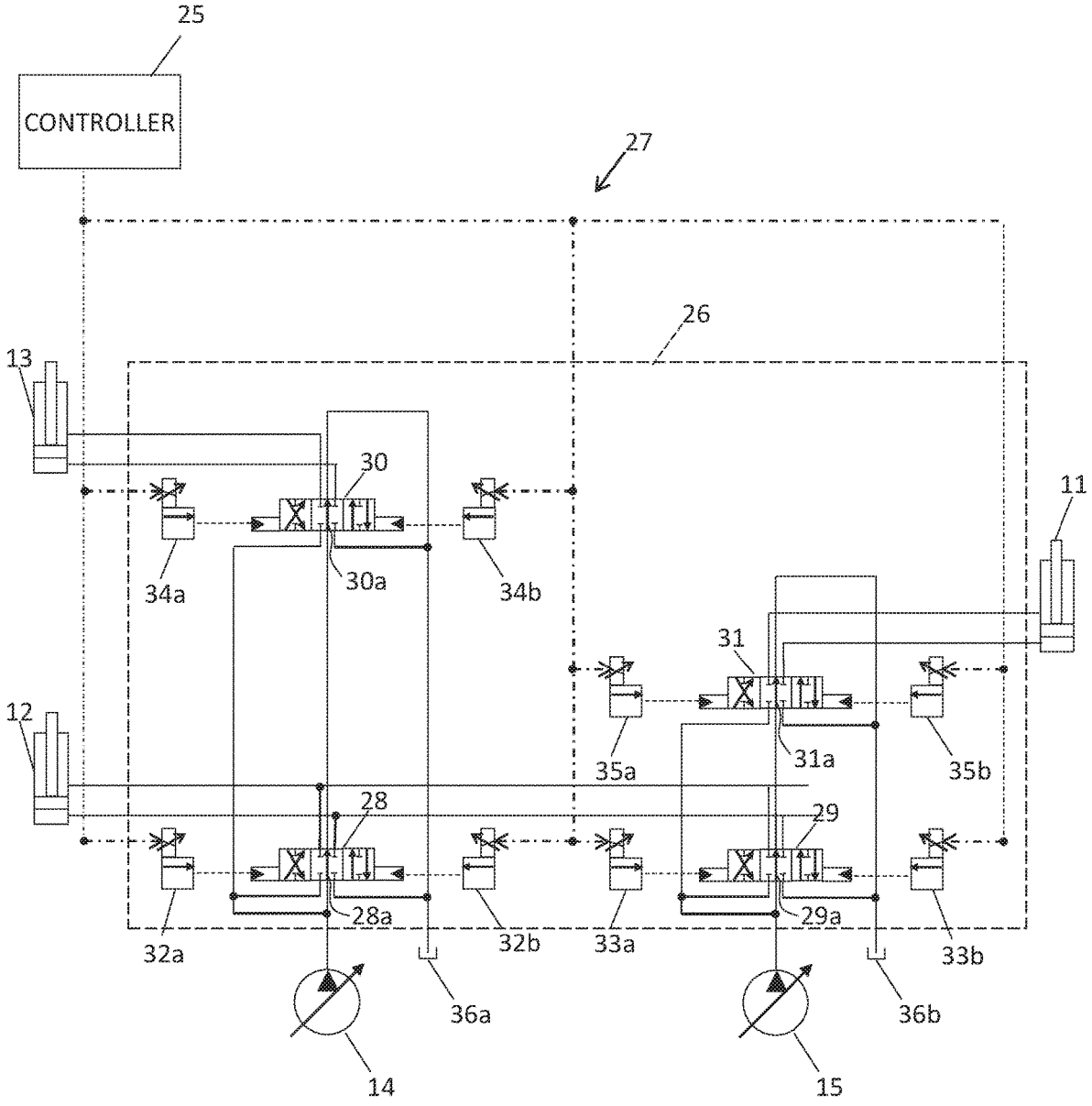
FIG. 5 is a schematic diagram of a hydraulic circuit 27 of the hydraulic excavator 1.

FIG. 5 is a schematic diagram of a hydraulic circuit 27 of the hydraulic excavator 1. The hydraulic circuit 27 is configured with the first hydraulic pump 14, the second hydraulic pump 15, the flow control valve device 26, and hydraulic operating fluid tanks 36*a* and 36*b*.

The flow control valve device 26 is configured with a first arm spool 28 that is a first flow control valve controlling the flow rate of the hydraulic operating fluid supplied from the first hydraulic pump 14 to the arm cylinder 12, a second arm spool 29 that is a third flow control valve controlling the flow rate of the hydraulic operating fluid supplied from the second hydraulic pump 15 to the arm cylinder 12, a bucket spool 30 controlling the flow rate of the hydraulic operating fluid supplied from the first hydraulic pump 14 to the boom cylinder 11, a boom spool (first boom spool) 31 that is a second flow control valve controlling the flow rate of the hydraulic operating fluid supplied from the second hydraulic pump 15 to the boom cylinder 11, first arm spool drive solenoid valves 32*a* and 32*b* driving the first arm spool 28, second arm spool drive solenoid valves 33*a* and 33*b* driving the second arm spool 29, bucket spool drive solenoid valves 34*a* and 34*b* driving the bucket spool 30, and boom spool drive solenoid valves (first boom spool drive solenoid valves) 35*a* and 35*b* driving the boom spool 31.

The first arm spool 28 and the bucket spool 30 are connected in parallel to the first hydraulic pump 14, while the second arm spool 29 and the boom spool 31 are connected in parallel to the second hydraulic pump 15.

The flow control valve device 26 is a so-called open center type (center bypass type) flow control valve device. The spools 28, 29, 30, and 31 have center bypass sections 28*a*, 29*a*, 30*a*, and 31*a* that are flow paths for guiding the hydraulic operating fluids delivered from the hydraulic pumps 14 and 15 to the hydraulic operating fluid tanks 36*a* and 36*b* until the spools 28, 29, 30, and 31 reach predetermined spool positions from neutral positions. In the present embodiment, the first hydraulic pump 14, the center bypass section 28*a* of the first arm spool 28, the center bypass section 30*a* of the bucket spool 30, and the tank 36*a* are connected in series in this order, and the center bypass sections 28*a* and 30*a* configure a center bypass flow path that guides the hydraulic operating fluid delivered from the first hydraulic pump 14 to the tank 36*a*. In addition, the second hydraulic pump 15, the center bypass section 29*a* of the second arm spool 29, the center bypass section 31*a* of the boom spool 31, and the tank 36*b* are connected in series in this order, and the center bypass sections 29*a* and 31*a* configure a center bypass flow path that guides the hydraulic operating fluid delivered from the second hydraulic pump 15 to the tank 36*b*.

A hydraulic fluid delivered from a pilot pump (not depicted) driven by the engine 16 is guided to the solenoid valves 32, 33, 34, and 35. When control signals are output from the controller 25 to be interlocked with an operation on the operation device 24, the solenoid valves 32, 33, 34, and 35 are actuated as appropriate on the basis of control commands from the controller 25 to cause the hydraulic fluid from the pilot pump to act on drive sections of the spools 28, 29, 30, and 31, whereby the spools 28, 29, 30, and 31 are driven to actuate the hydraulic cylinders 11, 12, and 13.

For example, in a case in which the controller 25 issues a command in relation to an expansion direction of the arm cylinder 12 by, for example, operator's operating the arm operation lever 24*a* in an arm crowding direction, then commands are issued to the first arm spool drive solenoid valve 32*a* and the second arm spool drive solenoid valve 33*a*, and the arm 9 performs a crowding action. Conversely, in a case in which the controller 25 issues a command in relation to a contraction direction (arm dumping direction), then commands are issued to the first arm spool drive solenoid valve 32*b* and the second arm spool drive solenoid valve 33*b*, and the arm 9 performs a dumping action. Likewise, in a case in which the controller 25 issues a command in relation to an expansion direction of the bucket cylinder 13 by, for example, operating the bucket operation lever 24*c* in a bucket crowding direction, then a command is issued to the bucket spool drive solenoid valve 34*a*, and the bucket 10 performs a crowding action, and in a case in which the controller 25 issues a command in relation to a contraction direction of the bucket cylinder 13, then a command is issued to the bucket spool drive solenoid valve 34*b*, and the bucket 10 performs a dumping action. Furthermore, likewise, in a case in which the controller 25 issues a command in relation to an expansion direction of the boom cylinder 11 by, for example, operating the boom operation lever 24*a* in a boom raising direction, then a command is issued to the boom spool drive solenoid valve 35*a*, and the boom 8 performs a raising action, and in a case in which the controller 25 issues a command in relation to a contraction direction (boom lowering direction) of the boom cylinder 11, then a command is issued to the boom spool drive solenoid valve 35*b*, and the boom 8 performs a lowering action.

Figure 6:
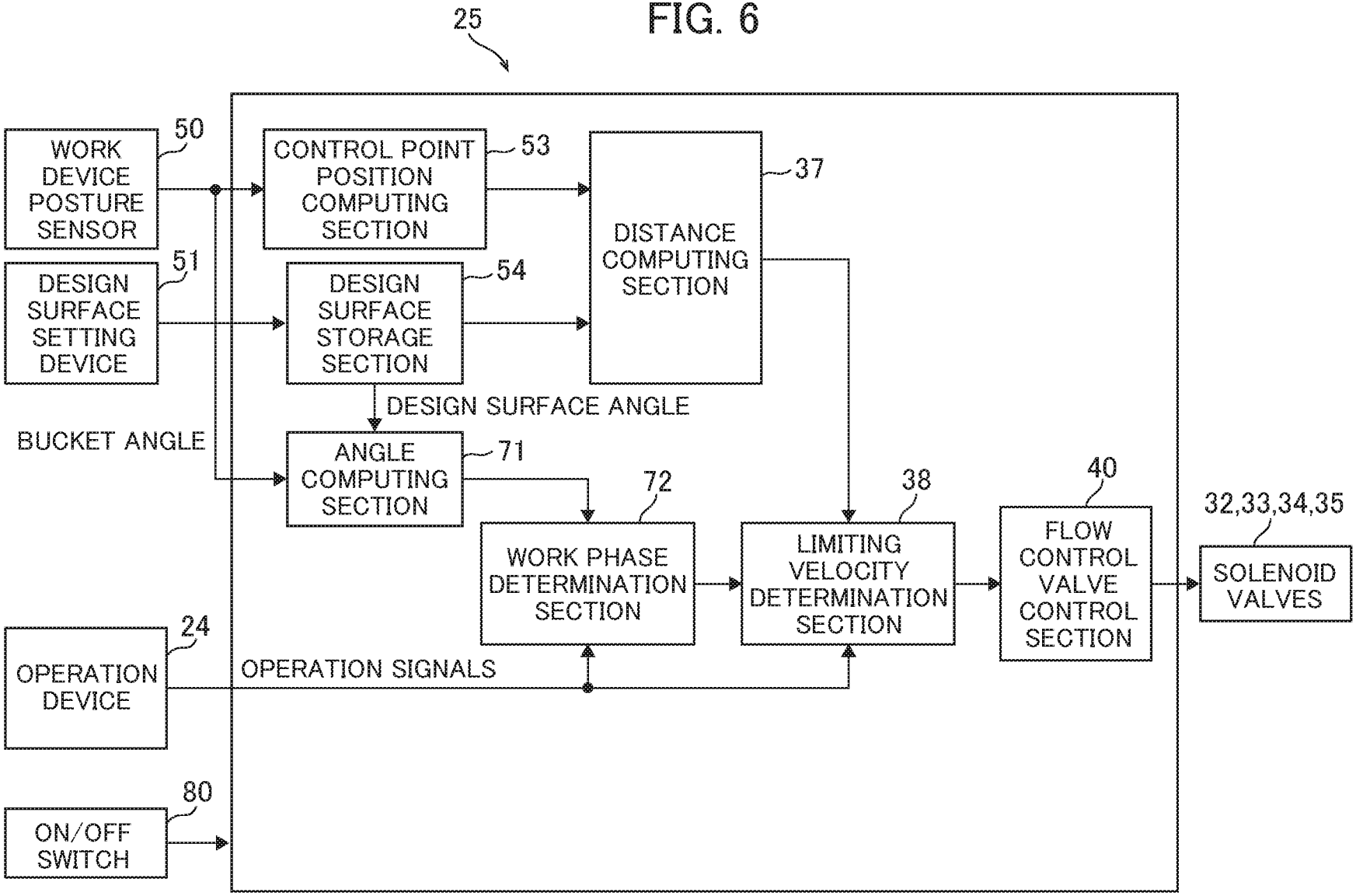
FIG. 6 is a functional block diagram of the controller 25 according to Embodiment 1.

FIG. 6 depicts a functional block diagram in which series of processing executed by the controller 25 according to the present embodiment are classified and organized into a plurality of blocks from a functional aspect. As depicted in FIG. 6, the series of processing executed by the controller 25 can be divided into a control point position computing section 53, a design surface storage section 54, a distance computing section 37, an angle computing section 71, a work phase determination section 72, a limiting velocity determination section 38, and a flow control valve control section 40.

The control point position computing section 53 computes a position of the bucket tip end P4 that is the control point in the global coordinate system in the present embodiment and postures of the front members 8, 9, and 10 of the work device 7 in the global coordinate system. While computing may be based on a well-known method, the control point position computing section 53 calculates, for example, first the coordinate values of the origin P0 (refer to FIG. 2), which is in the local coordinate system (machine body reference coordinate system), in the global coordinate system and posture data and azimuth data about the travel structure 2 and the swing structure 3 in the global coordinate system, from the navigation signals received by the first and second GNSS antennas 21 and 22. In addition, the control point position computing section 53 computes the position of the bucket tip end P4 that is the control point in the global coordinate system in the present embodiment and the postures of the front members 8, 9, and 10 of the work device 7 in the global coordinate system using information about the inclination angles θ1, θ2, θ3, and θ4 from the work device posture sensor 50, the coordinate values of the boom foot pin P1 in the local coordinate system, and the boom length L1, the arm length L2, and the bucket length L3. It is noted that the coordinate values of the control point of the work device 7 may be measured by an external measurement instrument such as a laser surveying instrument and the control point position computing section 53 may acquire the coordinate values by communication with the external surveying instrument.

The design surface storage section 54 stores the position data (design surface data) about the design surface 60 in the global coordinate system computed on the basis of data from the design surface setting device 51 provided within the operation room 4. As depicted in FIG. 2, in the present embodiment, a cross-sectional shape obtained by cutting three-dimensional data about the design surface by a plane on which the front members 8, 9, and 10 of the work device 7 are actuated (action plane of the work device 7) is used as the design surface 60 (two-dimensional design surface). While the number of design surfaces 60 is one in an example of FIG. 2, a plurality of design surfaces are often present. In a case in which the plurality of design surfaces are present, examples of a method of selecting one design surface include a method of setting a surface closest to the control point of the work device 7 as the design surface, a method of setting a surface located vertically below the bucket tip end P4 as the design surface, and a method of setting an optionally selected surface as the design surface. Furthermore, the position data about the design surface 60 may be position data about the design surface 60 around the hydraulic excavator 1 acquired from an external server by communication with the external server on the basis of the position data about the control point of the work device 7 in the global coordinate system, and may be stored in the design surface storage section 54. Alternatively, an operator may set the design surface 60.

The distance computing section 37 computes the distance D (refer to FIG. 2) between the control point of the work device 7 (for example, the bucket claw tip located on a tip end of the work device 7) and the design surface 60 from the position data about the control point of the work device 7 computed by the control point position computing section 53 and the position data about the design surface 60 acquired from the design surface storage section 54.

Figure 7:
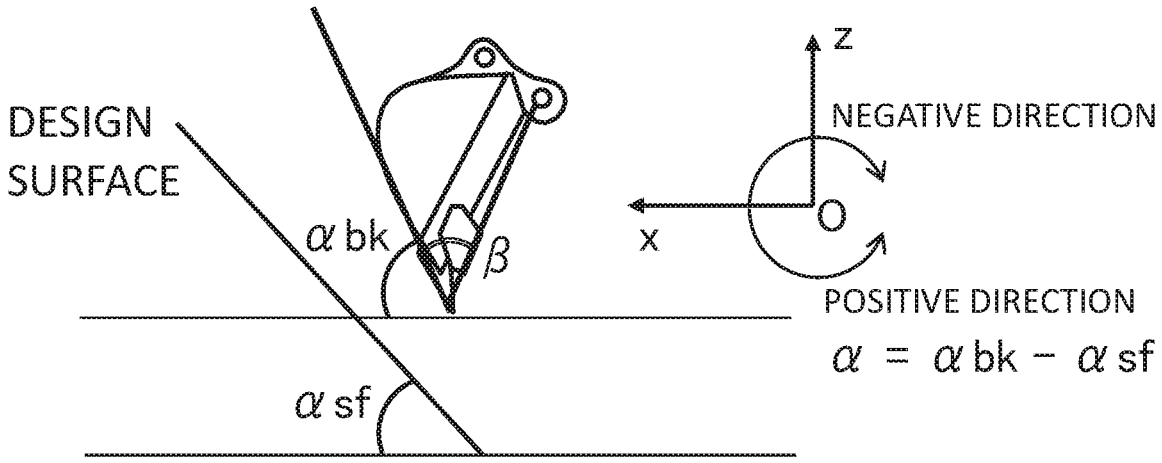
FIG. 7 is an explanatory diagram of an angle α formed between a bucket bottom surface and a design surface.

The angle computing section 71 is a section that computes an angle α formed between an angle (ground angle) abk of a bucket bottom surface with respect to a predetermined reference surface and an angle αsf of the design surface 60 with respect to the same reference surface on the basis of data input from the work device posture sensor 50 and the design surface storage section 54. The reference surface according to the present embodiment is a horizontal surface, and the angle αbk of the bucket bottom surface and the angle αsf of the design surface 60 are set with reference to an x-axis set on the horizontal surface, as depicted in FIG. 7. The angle α formed between the bucket bottom surface and the design surface 60 is defined as a value obtained by subtracting the angle αsf of the design surface with respect to the horizontal surface from the angle αbk of the bucket bottom surface with respect to the horizontal surface, that is, "α=αbk−αsf." As depicted in FIG. 7, it is defined that the angle α counterclockwise from the reference surface (x-axis) is positive. In other words, it is defined that a +x-axis on an xz plane is an initial side (zero degree), an angle in a direction of rotating counterclockwise is positive, and an angle in a direction of rotating clockwise is negative. In the present embodiment, an angle is defined in a range of ±180 degrees with reference to the +x-axis, two positive and negative notations (for example, +α and −180+α) are present per angle, and the angle having a smaller absolute value is selected. It is noted that the angles αbk and asf of FIG. 7 are both negative angles since being clockwise from the initial size (+x-axis).

The ground angle αbk of the bucket bottom surface can be calculated from the vehicle body longitudinal inclination angle θ4, the boom angle θ1, the arm angle θ2, the bucket angle θ3, and an angle β formed between a segment connecting the bucket pin position P3 to the claw tip coordinates P4 and a segment in a side view of the bucket bottom surface. The angle β is an angle specified from a bucket shape and can be grasped in advance. The angle αsf of the design surface 60 can be calculated from positions of two points on the design surface 60 stored in the design surface storage section 54.

Figure 8:
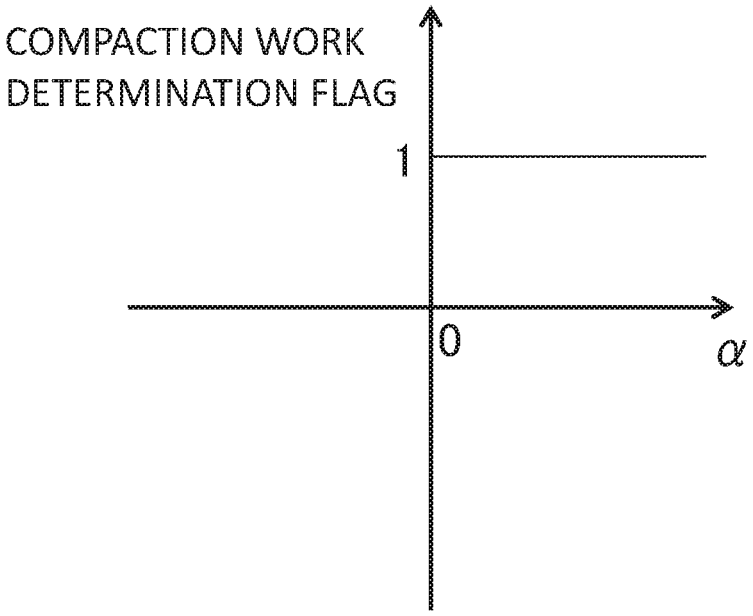
FIG. 8 is a table illustrating a relationship between the angle α and a compaction work determination flag.

The work phase determination section 72 is a section that determines whether a work phase of the work device 7 is compaction work on the basis of the angle α computed by the angle computing section 71 and any of operation signals output from the operation device 24. The work phase determination section 72 outputs a compaction work determination flag in response to the angle α. The compaction work determination flag is one of conditions for determining by the work phase determination section 72 that the work phase is compaction work. 1 is output as the compaction work flag when the angle α is equal to or greater than a predetermined value φ0, and 0 is output as the compaction work flag when the angle α is smaller than the predetermined value φ0. The predetermined value φ0 is preferably zero or a value closer to zero and may be a negative value. In other words, the predetermined value φ0 may be set in such a manner that 1 is output as the compaction work flag in a state in which the bucket bottom surface and the design surface 60 are either parallel or nearly parallel to each other. In a case of enlarging a range in which the work phase can be determined as the compaction work (range in which 1 is output as the flag), it is preferable to set φ0 to a negative value closer to zero. In the present embodiment, the predetermined value φ0 is set to zero as depicted in FIG. 8. FIG. 8 is a table indicating a relationship between the angle α and the compaction work determination flag in the present embodiment.

The work phase determination section 72 determines that the work phase of the work device 7 is compaction work when the compaction work flag described above is 1 and yet any of the operation signals is an operation signals instructing the work device 7 to approach the design surface 60. The "any of the operation signals is an operation signals instructing the work device 7 to approach the design surface 60" means herein an operation signal for giving an instruction of any one of boom lowering, arm dumping, and arm crowding. In other words, the work phase determination section 72 determines that the work phase of the work device is compaction work when the compaction work determination flag described above is 1 and either an operation signal for giving an instruction of boom lowering is input from the boom operation lever 24*a* or an operation signal for operating the arm 9 is input from the arm operation lever 44*a*. The work phase determination section 72 determines that the work phase is a bumping action for bumping the bucket bottom surface against a ground (surface to be worked) by boom lowering from the boom lowering operation signal, and that the work phase is a leveling compaction action for moving the bucket 10 along the design surface 60 while pushing the bucket bottom surface against the ground (surface to be worked) near the design surface 60 by arm dumping or crowding from the arm dumping or arm crowding operation signal.

The limiting velocity determination section 38 is a section that computes target velocities (limiting velocities) of the hydraulic cylinders 11, 12, and 13 in response to the distance D in such a manner that the action range of the work device 7 is limited onto or above the design surface 60 when the operation device 24 is operated. In the present embodiment, the limiting velocity determination section 38 executes the following computing.

First, the limiting velocity determination section 38 calculates a demanded velocity of the boom cylinder 11 (boom cylinder demanded velocity) from the voltage value (boom operation amount) input from the operation lever 24*a*, calculates a demanded velocity of the arm cylinder 12 from the voltage value (arm operation amount) input from the operation lever 24*b*, and calculates a demanded velocity of the bucket cylinder 13 from the voltage value (bucket operation amount) input from the operation lever 24*c*. The limiting velocity determination section 38 calculates a velocity vector (demanded velocity vector) V0 of the work device 7 on the bucket tip end P4 from these three demanded velocities and the postures of the front members 8, 9, and 10 of the work device 7 computed by the control point position computing section 53. The limiting velocity determination section 38 then also calculates a velocity component V0*z* in a design surface vertical direction and a velocity component V0*x* in a design surface horizontal direction of the velocity vector V0.

Figure 9:
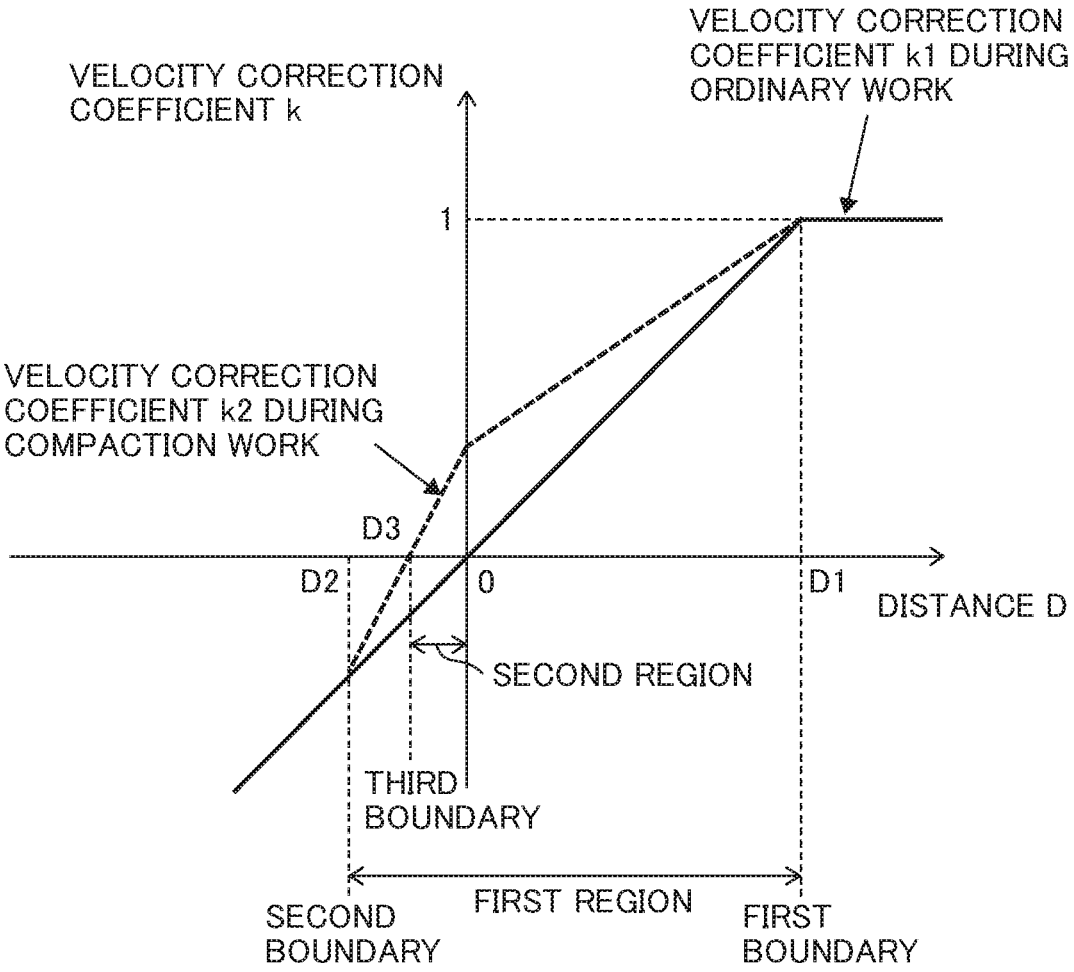
FIG. 9 is a graph representing a relationship between a distance D between a bucket tip end P4 and a design surface 60 and velocity correction coefficients k1 and k2.

Next, the limiting velocity determination section 38 computes correction coefficients k1 and k2 determined in response to the distance D. FIG. 9 is a graph representing a relationship between the distance D between the bucket tip end P4 and the design surface 60 and the velocity correction coefficients k1 and k2. While it is defined that a distance is positive when the bucket claw tip coordinates P4 (control point of the work device 7) are located above the design surface 60 and a distance is negative when the bucket claw tip coordinates P4 (control point of the work device 7) are located below the design surface 60, the velocity correction coefficients k1 and k2 are set in such a manner as to monotonically decrease as the distance D is smaller. In relation to a velocity direction of each of the target velocities (limiting velocities), a direction in which the work device 7 penetrates into below the design surface 60 is positive, and a direction of a velocity, for example, having a vertically downward component is positive in a case in which the design surface 60 is a horizontal surface.

As the velocity correction coefficient k, two values, that is, a value k1 during ordinary work (during work other than the compaction work) and a value k2 during the compaction work are set. The velocity correction coefficient k1 during the ordinary work is indicated by a solid line in FIG. 9 and set in such a manner as to be equal to zero when the distance D is zero.

On the other hand, as indicated by a broken line in FIG. 9, the velocity correction coefficient k2 during the compaction work is set to be greater than the velocity correction coefficient k1 during the ordinary work when the distance D falls in a predetermined range (first region specified by D2≤D≤D1 in an example of FIG. 9). By this setting, the limiting velocities (target velocities) during the compaction work are thereby higher than those during the ordinary work. In the present embodiment, a region (referred to as a "first region") surrounded by a first boundary set to a position of a distance D1 (for example, approximately + several tens of centimeters) above the design surface and a second boundary set to a position of a distance D2 (for example, approximately—5 centimeters) below the design surface is adopted as the "predetermined range." It is noted that in a case, for example, of conducting work in which the control point (bucket claw tip) does not penetrate into below the design surface 60, D2 may be set to zero, that is, the second boundary may be set onto the design surface 60.

Furthermore, for the compaction work (leveling compaction work) in a case in which an arm operation is input (that is, in a case in which any of the operation signals is an operation signal for giving an instruction of any one of arm dumping and arm crowding), the velocity correction coefficient k2 during the compaction work is set in such a manner as to be a positive value when the distance D falls in a predetermined range (second region specified by D3≤D≤0 in the example of FIG. 9) in which the velocity correction coefficient k1 during the ordinary work is set to be negative. Since the limiting velocities are thereby set positive in a case in which the control point moves below the design surface 60, it is possible to perform compaction of the design surface 60 by a leveling compaction action by the arm during finishing work or the like after the design surface 60 is generally formed. In the present embodiment, a region (referred to as a "second region") surrounded by a third boundary set to a position of a distance D3 above the second boundary set to the position of the distance D2 below the design surface 60 and below the design surface 60 and the design surface 60 is adopted as the "predetermined range." It is noted that in a case of, for example, not conducting work such as bumping, a boundary (design surface 60 in the example of FIG. 9) opposite to the third boundary in the second region may be set above the design surface.

It is noted that the velocity correction coefficient k2 during the compaction work out of the first region (D<D2 or D1<D) is set to the same value as the value of the velocity correction coefficient k1 during the ordinary work.

Next, the limiting velocity determination section 38 calculates a velocity component V1*z* by multiplying the velocity component V0*z* of the velocity vector V0 in the design surface vertical direction by the correction coefficient k1 or k2 determined in response to the distance D. The limiting velocity determination section 38 calculates a resultant velocity vector (target velocity vector) V1 by combining the velocity component V1*z* with the velocity component V0*x* of the velocity vector V0 in the design surface horizontal direction, and computes a boom cylinder velocity, an arm cylinder velocity (Va1), and a bucket cylinder velocity at which the resultant velocity vector V1 can be generated as the target velocities (limiting velocities). At a time of computing these target velocities, the limiting velocity determination section 38 may use the postures of the front members 8, 9, and 10 of the work device 7 computed by the control point position computing section 53.

Figure 10:
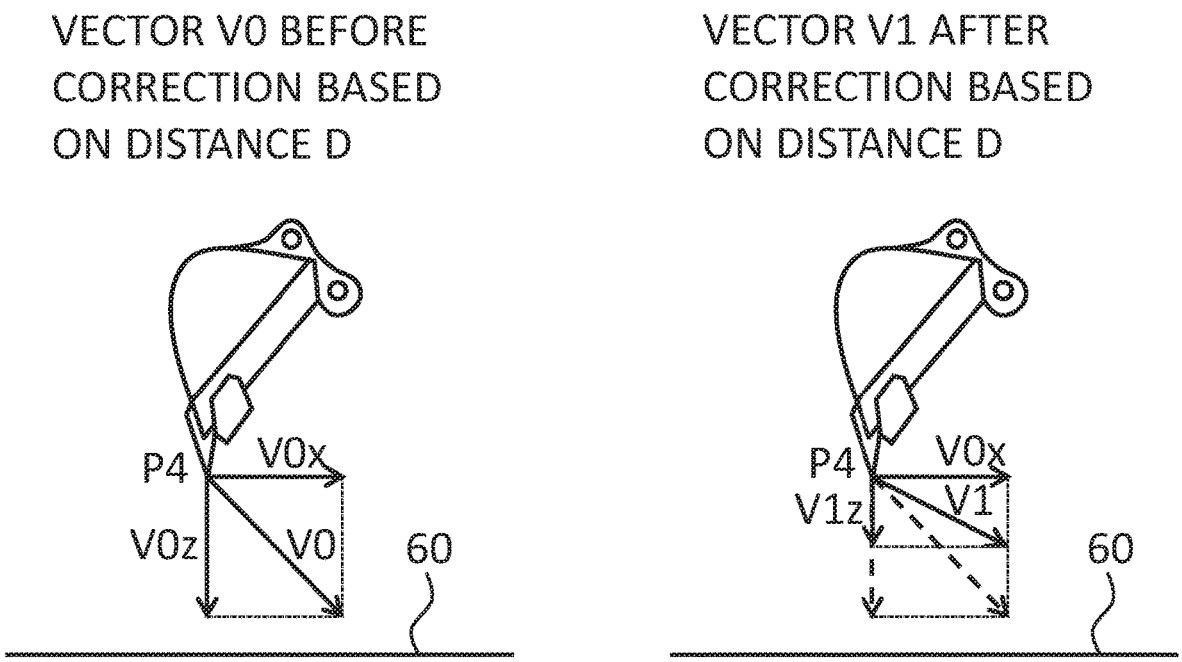
FIG. 10 is a pattern diagram representing velocity vectors before and after correction in response to the distance D on the bucket tip end P4.

FIG. 10 is a pattern diagram representing velocity vectors before and after correction in response to the distance D on the bucket tip end P4. The limiting velocity determination section 38 obtains the velocity vector V1*z* (refer to the right side of FIG. 8) equal to or smaller than V0*z* in the design surface vertical direction by multiplying the component V0*z* (refer to the left side of FIG. 8) of the demanded velocity vector V0 in the design surface vertical direction by the velocity correction coefficient k1 or k2. The limiting velocity determination section 38 calculates a resultant velocity vector V1 by combining V1*z* with the velocity component V0*x* of the demanded velocity vector V0 in the design surface horizontal direction, and computes an arm cylinder target velocity Va1, a boom cylinder target velocity, and a bucket cylinder target velocity at which V1 can be generated.

Figure 11:
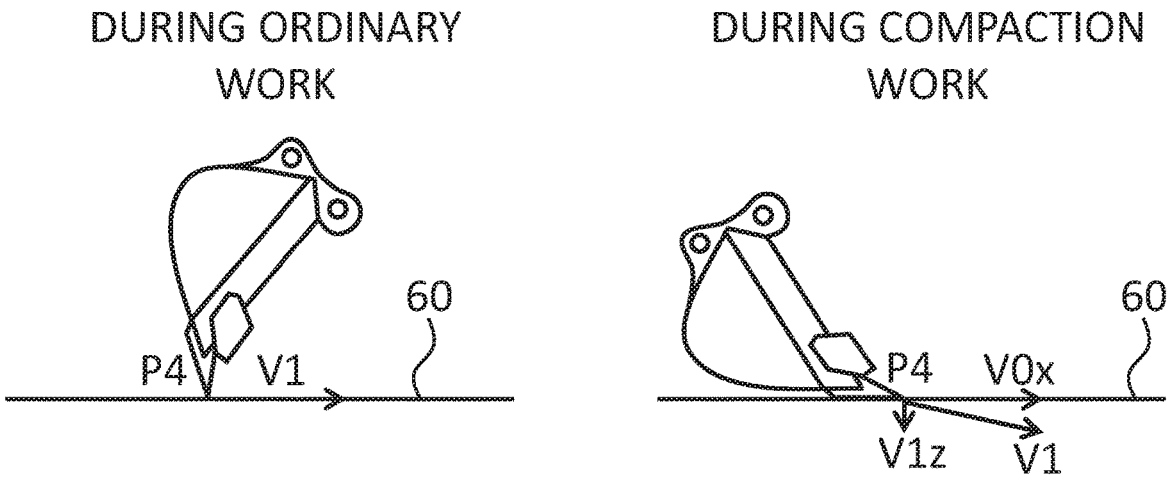
FIG. 11 is a pattern diagram representing velocity vectors after correction in response to the distance D on the bucket tip end P4 during ordinary work and compaction work.

FIG. 11 is a pattern diagrams representing velocity vectors after correction in response to the distance D on the bucket tip end P4 during the ordinary work and the compaction work. During the ordinary work (left in FIG. 11), since the velocity correction coefficient k1 becomes zero according to the table of FIG. 9 when the distance D between the bucket claw tip coordinates P4 and the design surface 60 is zero, V1*z* is equal to zero. However, during the compaction work (right in FIG. 11), since the velocity correction coefficient k2 is changed from zero to a positive value according to the table of FIG. 9, V1*z* becomes a positive value.

The flow control valve control section 40 is a section that computes control commands given to the solenoid valves 32, 33, 34, and 35 on the basis of the target velocities of the hydraulic cylinders 11, 12, and 13 computed by the limiting velocity determination section 38, and that controls the flow control valves (spools) 28, 29, 30, and 31 by outputting the control commands to the corresponding solenoid valves 32, 33, 34, and 35.

In relation to control over the arm cylinder 12, the target velocity of the arm cylinder 12 computed by the limiting velocity determination section 38 is input to the flow control valve control section 40, and the flow control valve control section 40 computes and outputs control commands to the first arm spool drive solenoid valves 32*a* and 32*b* and the second arm spool drive solenoid valves 33*a* and 33*b* (specifically, command current values specifying valve opening degrees of the first arm spool drive solenoid valves 32*a* and 32*b* and the second arm spool drive solenoid valves 33*a* and 33*b*) corresponding to the target velocity. In computing the control commands given to the first arm spool drive solenoid valves 32*a* and 32*b* and the second arm spool drive solenoid valves 33*a* and 33*b*, the flow control valve control section 40 in the present embodiment uses tables in which one-to-one correlations between the target velocity of the arm cylinder 12 and the control commands given to the first arm spool drive solenoid valves 32*a* and 32*b* and the second arm spool drive solenoid valves 33*a* and 33*b* are specified. These tables include first a table for the first arm spool drive solenoid valve 32*a* and a table for the second arm spool drive solenoid valve 33*a* as two tables used in a case of expanding the arm cylinder 12. In addition, the tables include a table for the first arm spool drive solenoid valve 32*b* and a table for the second arm spool drive solenoid valve 33*b* as two tables used in a case of contracting the arm cylinder 12. In these four tables, correlations between the target velocity and the current values for the solenoid valves 32*a*, 32*b*, 33*a*, and 33*b* are specified in such a manner that the current values for the solenoid valves 32*a*, 32*b*, 33*a*, and 33*b* monotonically increase in proportion to an increase in a magnitude of the arm cylinder target velocity on the basis of a relationship between the current values for the solenoid valves 32*a*, 32*b*, 33*a*, and 33*b* and an actual velocity of the arm cylinder 12 obtained by an experiment or a simulation in advance.

In relation to control over the boom cylinder 11, the target velocity of the boom cylinder 11 computed by the limiting velocity determination section 38 is input to the flow control valve control section 40, and the flow control valve control section 40 computes and outputs control commands to the boom spool drive solenoid valves 35*a* and 35*b* (specifically, command current values specifying valve opening degrees of the boom spool drive solenoid valves 35*a* and 35*b*) corresponding to the target velocity. In computing the control commands given to the boom spool drive solenoid valves 35*a* and 35*b*, the flow control valve control section 40 in the present embodiment uses tables in which one-to-one correlations between the target velocity of the boom cylinder 11 and the control commands given to the boom spool drive solenoid valves 35*a* and 35*b* are specified. These tables include a table for the boom spool drive solenoid valve 35*a* used in a case of expanding the boom cylinder 11 and a table for the boom spool drive solenoid valve 35*b* used in a case of contracting the boom cylinder 11. In these two tables, correlations between the target velocity and the current values for the solenoid valves 35*a* and 35*b* are specified in such a manner that the current values for the solenoid valves 35*a* and 35*b* monotonically increase in proportion to an increase in a magnitude of the boom cylinder target velocity on the basis of a relationship between the current values for the solenoid valves 35*a* and 35*b* and an actual velocity of the boom cylinder 11 obtained by an experiment or a simulation in advance.

In relation to control over the bucket cylinder 13, the target velocity of the bucket cylinder 13 computed by the limiting velocity determination section 38 is input to the flow control valve control section 40, and the flow control valve control section 40 computes and outputs control commands to the bucket spool drive solenoid valves 34*a* and 34*b* (specifically, command current values specifying valve opening degrees of the bucket spool drive solenoid valves 34*a* and 34*b*) corresponding to the target velocity. In computing the control commands given to the bucket spool drive solenoid valves 34*a* and 34*b*, the flow control valve control section 40 in the present embodiment uses tables in which one-to-one correlations between the target velocity of the bucket cylinder 13 and the control commands given to the bucket spool drive solenoid valves 34*a* and 34*b* are specified. These tables include a table for the bucket spool drive solenoid valve 34*a* used in a case of expanding the bucket cylinder 13 and a table for the bucket spool drive solenoid valve 34*b* used in a case of contracting the bucket cylinder 13. In these two tables, correlations between the target velocity and the current values for the solenoid valves 34*a* and 34*b* are specified in such a manner that the current values for the solenoid valves 34*a* and 34*b* monotonically increase in proportion to an increase in a magnitude of the bucket cylinder target velocity on the basis of a relationship between the current values for the solenoid valves 34*a* and 34*b* and an actual velocity of the bucket cylinder 13 obtained by an experiment or a simulation in advance.

In the case, for example, in which the commands about the arm cylinder target velocity and the boom cylinder target velocity are present, the flow control valve control section 40 generates the control commands given to the solenoid valves 32, 33, and 35 and drives the first arm spool 28, the second arm spool 29, and the boom spool 31.

Figure 12:
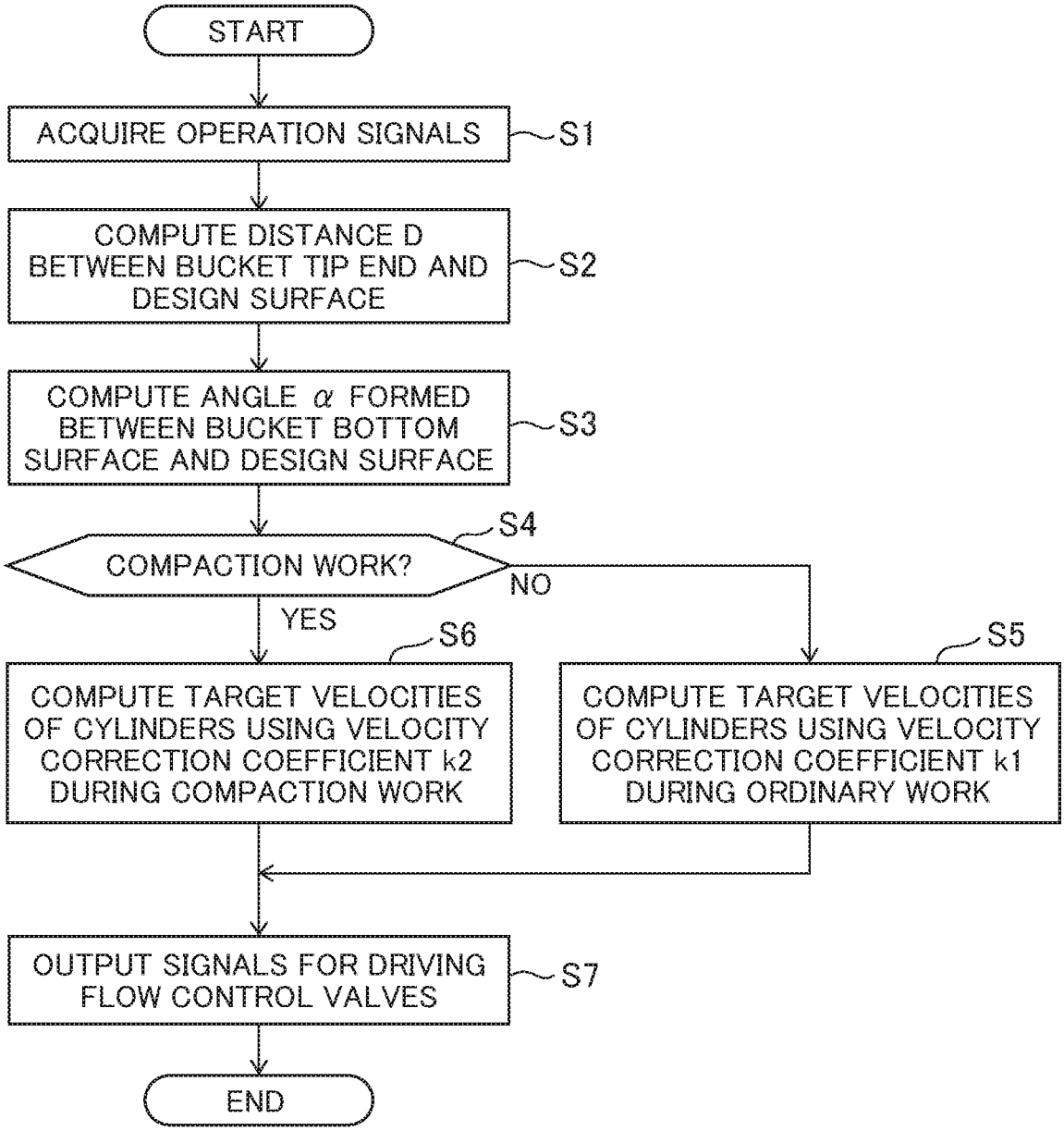
FIG. 12 is a flowchart representing a control flow performed by the controller 25 according to Embodiment 1.

FIG. 12 is a flowchart representing a control flow performed by the controller 25. Upon operator's operating the operation device 24, the controller 25 starts processing of FIG. 12, and the work phase determination section 72 and the limiting velocity determination section 38 acquire the operation signals output by operating the operation device 24 (Procedure S1).

In Procedure S2, the control point position computing section 53 computes the position data about the bucket tip end P4 (control point) in the global coordinate system on the basis of data about the inclination angles θ1, θ2, θ3, and θ4 from the work device posture sensor 50, position data, posture data (angle data), and azimuth data about the hydraulic excavator 1 computed from navigation signals output from the GNSS antennas 21 and 22, dimension data L1, L2, and L3 about the front members stored in advance, and the like. Next, the distance computing section 37 extracts and acquires position data (target surface data) about design surfaces falling in the predetermined ranges with reference to the position data about the bucket tip end P4 in the global coordinate system computed by the control point position computing section 53 (or by use of the position data about the hydraulic excavator 1), from the design surface storage section 54. In addition, the distance computing section 37 sets the design surface located at a position closest to the bucket tip end P4 as the design surface 60 of an object to be controlled, that is, the design surface 60 for which the distance D is computed from among the design surfaces.

In addition, the distance computing section 37 computes the distance D on the basis of the position data about the bucket tip end P4 and the position data about the design surface 60, and the processing goes to Procedure S3.

In Procedure S3, the angle computing section 71 computes the angle α formed between the ground angle αbk of the bucket bottom surface and the angle αsf of the design surface 60. In computing the angle α, the angle computing section 71 computes first the ground angle (bucket angle) abk of the bucket bottom surface from the data acquired from the work device posture sensor 50 and the angle β of the bucket stored in the storage device of the controller 25 in advance. Next, the angle computing section 71 computes the angle αsf (design surface angle) of the design surface 60 on the basis of the positions of the two points on the design surface 60 for which the distance D is stored and which is stored in the design surface storage section 54. In addition, the angle computing section 71 computes the angle α formed between the ground angle αbk of the bucket bottom surface and the angle αsf of the design surface 60 by subtracting the angle αsf of the design surface 60 from the ground angle αbk of the bucket bottom surface.

In Procedure S4, the work phase determination section 72 determines whether a work phase of the work device 7 is compaction work on the basis of the angle α computed in Procedure S3 and any of the operation signals acquired in Procedure S1. In determining the work phase, the work phase determination section 72 determines first whether the angle α computed in Procedure S3 is equal to or greater than the predetermined value φ0 (=0), outputs 1 as the compaction work flag in a case in which the angle α is equal to or greater than the predetermined angle φ0, and outputs 0 as the compaction work flag in a case in which the angle α is smaller than the predetermined angle φ0. In a case of outputting 1 as the compaction work flag, the work phase determination section 72 determines whether any of the operation signals acquired in Procedure S1 is an operation signal for giving an instruction of boom lowering, arm dumping, or arm crowding. In a case in which the operation signal corresponds to any one of these actions, then the work phase determination section 72 determines that the current work phase is the compaction work, and the processing goes to Procedure S6. On the other hand, in a case in which the compaction work flag is 0 or in a case in which the compaction work determination flag is 1 but any of the operation signals is an operation signal corresponding to an action other than the three types of actions described above, then the work phase determination section 72 determines that the current work phase is the ordinary work, and the processing goes to Procedure S5.

In Procedure S5, the limiting velocity determination section 38 computes the velocity correction coefficient k1 during the ordinary work corresponding to the distance D computed in Procedure S2 by using the table (solid line) of FIG. 9. In addition, the limiting velocity determination section 38 computes the velocity vector V0 of the work device 7 on the bucket tip end P4 from the operation signals (voltage values) of the operation levers input from the operation device 24 and acquired in Procedure S1 and the postures of the front members 8, 9, and 10, and also computes the velocity component V0*z* in the design surface vertical direction and the velocity component V0*x* in the design surface horizontal direction of the velocity vector V0. Next, the limiting velocity determination section 38 calculates the velocity component V1*z* by multiplying the velocity component V0*z* in the design surface vertical direction by the previously computed velocity correction coefficient k1 during the ordinary work. The limiting velocity determination section 38 calculates the resultant velocity vector (target velocity vector) V1 by combining the velocity component V1*z* with the velocity component V0*x* of the velocity vector V0 in the design surface horizontal direction, and computes the boom cylinder velocity, the arm cylinder velocity, and the bucket cylinder velocity at which the resultant velocity vector V1 can be generated as the target velocities (limiting velocities).

In Procedure S6, the limiting velocity determination section 38 computes the velocity correction coefficient k2 during the compaction work corresponding to the distance D computed in Procedure S2 by using the table (broken line) of FIG. 9. In addition, the limiting velocity determination section 38 computes the velocity vector V0 of the work device 7 on the bucket tip end P4 from the operation signals (voltage values) of the operation levers input from the operation device 24 and acquired in Procedure S1 and the postures of the front members 8, 9, and 10, and also computes the velocity component V0*z* in the design surface vertical direction and the velocity component V0*x* in the design surface horizontal direction of the velocity vector V0. Next, the limiting velocity determination section 38 calculates the velocity component V1*z* by multiplying the velocity component V0*z* in the design surface vertical direction by the previously computed velocity correction coefficient k2 during the compaction work. The limiting velocity determination section 38 calculates the resultant velocity vector (target velocity vector) V1 by combining the velocity component V1*z* with the velocity component V0*x* of the velocity vector V0 in the design surface horizontal direction, and computes the boom cylinder velocity, the arm cylinder velocity, and the bucket cylinder velocity at which the resultant velocity vector V1 can be generated as the target velocities (limiting velocities).

In Procedure S7, the flow control valve control section 40 computes signals for driving the flow control valves 28 to 31 corresponding to the cylinders 11, 12, and 13 from the target velocities (limiting velocities) of the cylinders 11, 12, and 13 computed in Procedure S5 or S6, and outputs the signals to the corresponding solenoid valves 32 to 35. Specifically, the flow control valve control section 40 computes signals for driving the first flow control valve (first arm spool) 28 and the third flow control valve (second arm spool) 29 from the target velocity of the arm cylinder velocity, and outputs the signals to either the solenoid valves 32*a* and 33*a* or the solenoid valves 32*b* and 33*b*. The flow control valve control section 40 computes a signal for driving the second flow control valve (boom spool) 31 from the target velocity of the boom cylinder velocity, and outputs the signal to either the solenoid valve 35*a* or 35*b*, and the processing goes to Procedure S12. The flow control valve control section 40 computes a signal for driving the flow control valve (bucket spool) 30 from the target velocity of the bucket cylinder velocity, and outputs the signal to either the solenoid valve 34*a* or 34*b*.

When the processing in Procedure S7 is ended, then the processing returns to Start upon confirming that the operation on the operation device 24 continues, and the processing in and after Procedure S1 is repeated. It is noted that the processing is ended and waits until start of a next operation on the operation device 24 in a case in which the operation on the operation device 24 is finished even halfway along the flow of FIG. 12.

<Actions and Advantages>

(1) During Ordinary Work (During Excavation Work)

During excavation work included in the ordinary work, the excavation work is started normally by moving the bucket 10 up to an excavation start position located in front of the excavator by an arm dumping operation, and inputting an arm crowding operation from a state of standing the bucket claw tip on the design surface 60. At this time, the angle α formed between the bucket bottom surface and the design surface 60 is a value closer to—90 degrees, and 0 is output as the compaction work determination flag. Owing to this, it is determined that the work phase is the ordinary work in Procedure S4 of FIG. 12 irrespectively of the operation signals; thus, the velocities of the cylinders 11, 12, and 13 are limited on the basis of the velocity correction coefficient k1 during the ordinary work (Procedure S5). In other words, as the bucket tip end P4 is closer to the design surface 60, then the components of the velocities of the work device 7 in the design surface vertical direction are controlled to be closer to zero, and the work device 7 is kept onto or above the design surface 60.

(2-1) During Compaction Work (Bumping)

During bumping work included in the compaction work, the work is started by making the posture of the bucket 10 fixed to a state in which the angle α formed between the bucket bottom surface and the design surface 60 is close to zero (that is, a state in which the bucket bottom surface and the design surface 60 are nearly parallel to each other), and inputting a boom lowering operation. In the present embodiment, the compaction work determination flag is 1 when the angle α formed between the bucket bottom surface and the design surface 60 is equal to or greater than zero (that is, when the bucket bottom surface is parallel to the design surface 60 or when the bucket 10 has a posture in which the bucket claw tip is located above the bucket bottom surface). In a case in which the compaction work determination flag is 1 and yet a boom lowering operation is input, it is determined in Procedure S4 of FIG. 12 that the work phase is the compaction work. In a case in which the distance D falls in the first region (D2≤D≤D1), the velocities of the cylinders 11, 12, and 13 are limited on the basis of the velocity correction coefficient k2 (velocity correction coefficient during the compaction work) greater than the velocity correction coefficient during the ordinary work (Procedure S6). In other words, since it is permitted that the components of the velocities of the work device 7 in the design surface vertical direction take on positive values on the design surface 60, it is possible to favorably perform compaction of the ground (surface to be worked) by the bucket bottom surface during bumping. Particularly in the present embodiment, the angle α formed between the bucket bottom surface and the design surface 60 is used in determination of the work phase, and the same control as that during the ordinary work is exercised in a case in which the angle α is smaller than zero and the bucket has a posture in which the bucket claw tip is possibly stuck into the design surface 60. In other words, the work device 7 is controlled in such a manner that the components of the velocities of the work device 7 in the design surface vertical direction are closer to zero as the bucket tip end P4 is closer to the design surface 60; thus, it is possible to prevent the surface to be worked from being damaged.

(2-2) During Compaction Work (Leveling Compaction)

During leveling compaction work included in the compaction work, the work is started by inputting an arm crowding operation or an arm dumping operation in a state in which a bucket back surface is brought into contact with the ground after the design surface 60 is almost formed (that is, in a state in which the angle α formed between the bucket bottom surface and the design surface 60 is close to zero). In addition, the design surface 60 is compacted by moving the bucket 10 while pushing the bucket back surface against the ground by the arm operation. During the leveling compaction work, the bucket claw tip is not infrequently, already located onto the design surface 60 at a time of starting compaction from the nature of the work that is quite often conducted after formation of the design surface. In that case, normally, the bucket claw tip is moved slightly below the design surface 60 by a compaction action (arm operation). In the present embodiment, the work phase is determined to be the compaction work in Procedure S4 of FIG. 12 in the case in which the compaction work determination flag is 1 and yet the arm operation is input, and the velocity correction coefficient that is a negative value during the ordinary work is changed to a positive value in the case in which the distance D falls in the second region (D3≤D≤0). In other words, since it is permitted that the components of the velocities of the work device 7 in the design surface vertical direction take on positive values in the second region immediately under the design surface 60, it is possible to favorably perform compaction of the ground (surface to be worked) by the bucket bottom surface even if the arm operation is started from the state in which the bucket claw tip is located onto the design surface 60 or quite in the vicinity of the design surface 60.

As described so far, according to the present embodiment, the work phase is determined to be the compaction work when the angle α formed between the bucket bottom surface and the design surface 60 is equal to or greater than the predetermined value φ0 and the arm operation signal or the boom lowering operation signal is output; thus, it is possible to accurately determine the compaction work. Furthermore, during the compaction work (bumping) by the boom lowering operation, setting the velocity correction coefficient of the work device 7 to be greater than that during the ordinary work when the distance D falls in the first region (D2≤D≤D1) makes it possible to favorably conduct the compaction work by the bumping. Moreover, during the compaction work (leveling compaction work) by the arm operation, setting the velocity correction coefficient k to the positive value when the distance D falls in the second region (D3≤D≤0) makes it possible to generate the velocities in the design surface vertical direction and favorably conduct the leveling compaction work.

Embodiment 2

Figure 13:
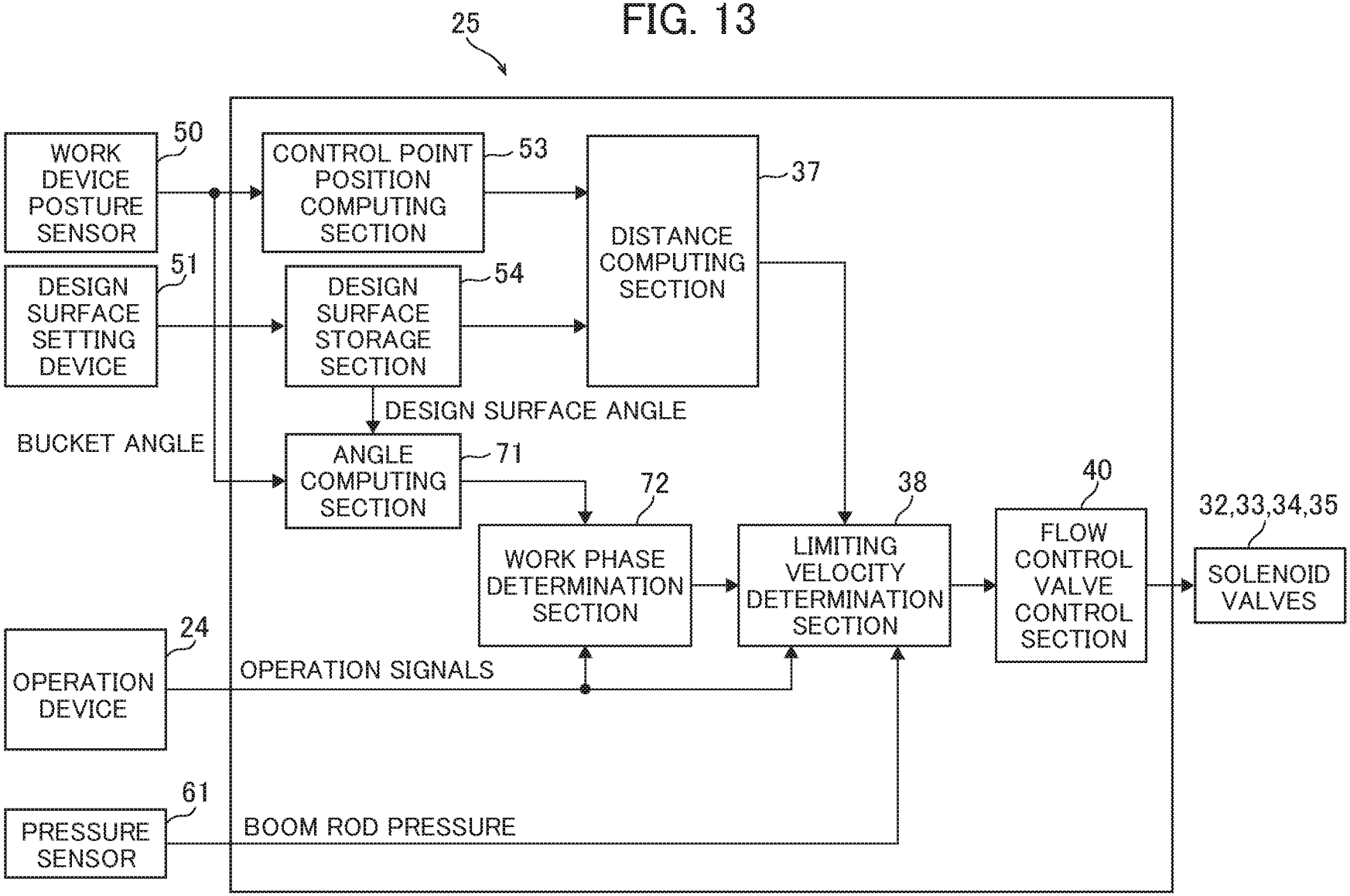
FIG. 13 is a functional block diagram of the controller 25 of a work machine according to Embodiment 2 of the present invention.

Embodiment 2 of the present invention will be described. Since hardware configurations are the same as those in Embodiment 1, description of the hardware configurations will be omitted and different respects will be described herein. FIG. 13 is a functional block diagram of the controller 25 according to Embodiment 2 of the present invention. The controller 25 is characterized in that the limiting velocity determination section 38 computes the limiting velocities further in consideration of the rod pressure (often referred to as a boom rod pressure) of the boom cylinder. The limiting velocity determination section 38 in the present embodiment carries out compaction work determination using boom rod pressure data acquired from the pressure sensor 61.

Figure 14:
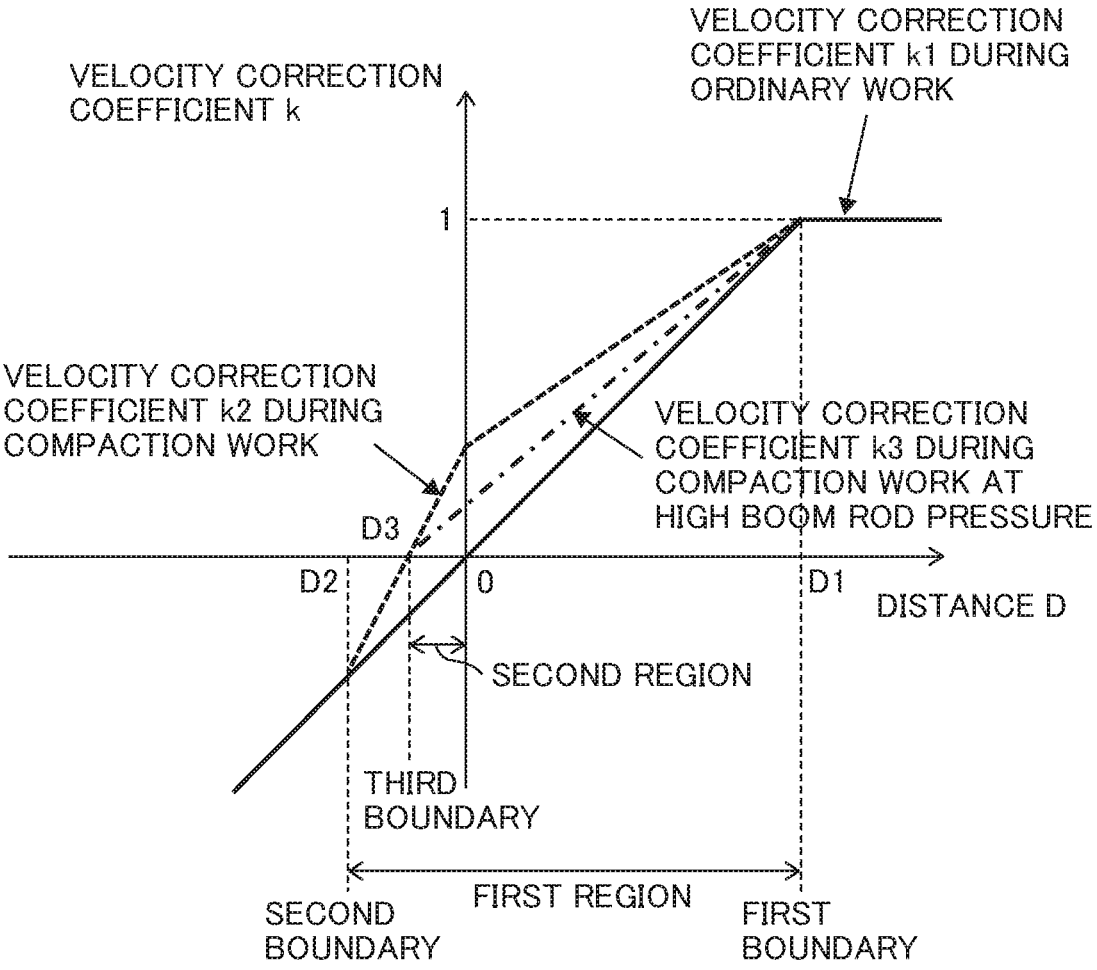
FIG. 14 is a graph representing a relationship between the distance D between the bucket tip end P4 and the design surface 60 and velocity correction coefficients k1, k2, and k3.

Furthermore, as depicted in FIG. 14, the limiting velocity determination section 38 in the present embodiment corrects a velocity correction coefficient k3 during the compaction work when the boom rod pressure is equal to or higher than a predetermined pressure P1 (hereinafter, often simply referred to as "during the high pressure") in such a manner as to be smaller than the value k2 during ordinary compaction work (indicated by a broken line in FIG. 14 (that is, the velocity correction coefficient during the compaction work in Embodiment 1)).

Figure 15:
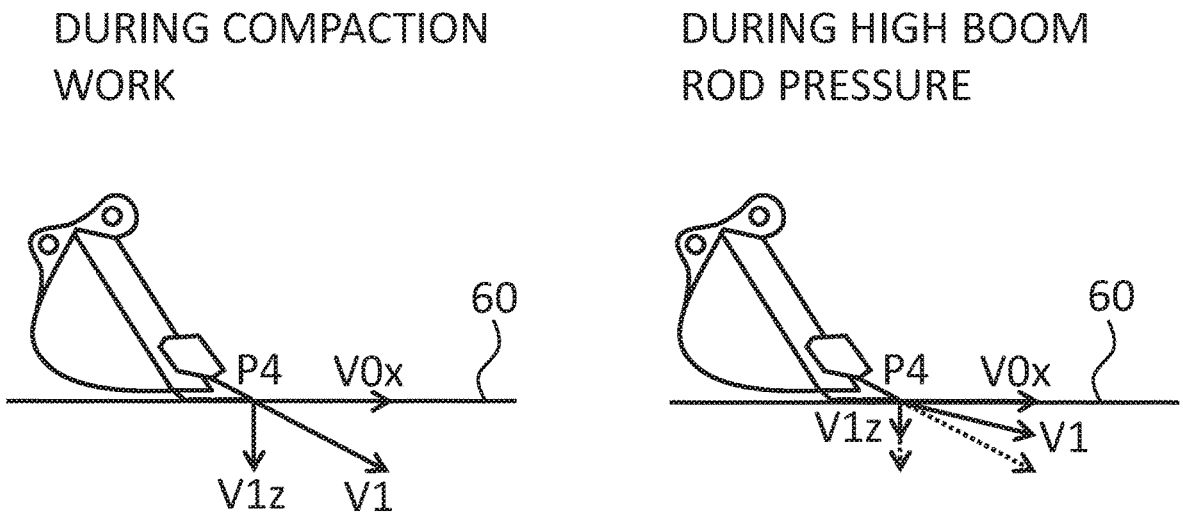
FIG. 15 is a pattern diagram representing velocity vectors after correction on the bucket tip end P4 during compaction work when a boom rod pressure is high.

FIG. 15 is a pattern diagram representing velocity vectors after correction on the bucket tip end P4 during the compaction work when the boom rod pressure is high. As depicted in FIG. 15, at a point on the design surface 60 at which the distance D is, for example, equal to zero, the component V1*z* of the velocity vector in the design surface vertical direction during the high boom rod pressure (right in FIG. 15) is smaller than the component V1*z* of the velocity vector in the design surface vertical direction during the ordinary compaction work (left in FIG. 15) (that is, the limiting velocity during the high boom rod pressure is lower than that during the ordinary compaction work).

Figure 16:
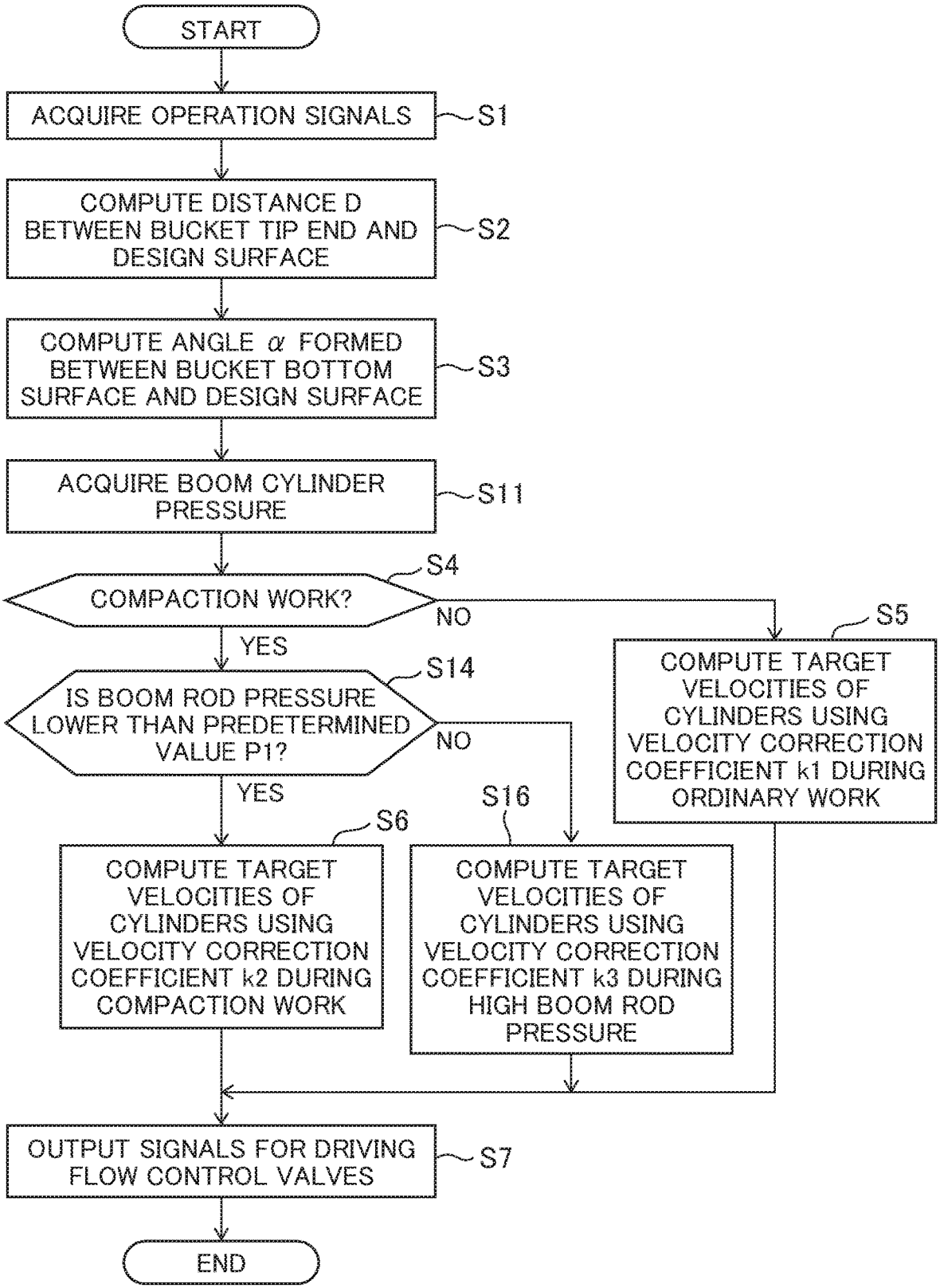
FIG. 16 is a flowchart representing a control flow performed by the controller 25 according to Embodiment 2.

FIG. 16 is a flowchart representing a control flow performed by the controller 25 according to the present embodiment. The same procedures as those in FIG. 12 are denoted by the same reference characters and description thereof will be omitted, while different procedures will be described herein.

In Procedure S11, the detection signal of the boom rod pressure sensor 61 is input to the limiting velocity determination section 38 and the limiting velocity determination section 38 acquires the rod pressure of the boom cylinder 11.

In Procedure S14, the limiting velocity determination section 38 determines whether the boom rod pressure acquired in Procedure S11 is lower than a predetermined value P1, goes to Procedure S6 in a case in which the boom rod pressure is lower than P1, and goes to Procedure S16 in a case in which the boom rod pressure is equal to or higher than P1.

In Procedure S16, the limiting velocity determination section 38 computes the velocity correction coefficient k3 during the compaction work at the high boom rod pressure corresponding to the distance D computed in Procedure S2 by using a table (dot-and-dash line) of FIG. 14. In addition, the limiting velocity determination section 38 computes the velocity vector V0 of the work device 7 on the bucket tip end P4 from the operation signals (voltage values) of the operation levers input from the operation device 24 and acquired in Procedure S1 and the postures of the front members 8, 9, and 10, and also computes the velocity component V0*z* in the design surface vertical direction and the velocity component V0*x* in the design surface horizontal direction of the velocity vector V0. Next, the limiting velocity determination section 38 calculates the velocity component V1*z* by multiplying the velocity component V0*z* in the design surface vertical direction by the previously computed velocity correction coefficient k3. The limiting velocity determination section 38A calculates the resultant velocity vector (target velocity vector) V1 by combining the velocity component V1*z* with the velocity component V0*x* of the velocity vector V0 in the design surface horizontal direction, and computes the boom cylinder velocity, the arm cylinder velocity, and the bucket cylinder velocity at which the resultant velocity vector V1 can be generated as the target velocities (limiting velocities).

<Actions and Advantages>

During the leveling compaction work for pushing the bucket bottom surface against a current configuration of the ground and compacting the ground by the arm operation, a force for supporting compaction by the arm 9 acts on a hydraulic chamber on a rod side of the boom cylinder 11, thus the boom rod pressure rises. Owing to this, in a case of an excessive compaction force by the arm 9, the travel structure 2 of the excavator possibly floats from the ground. To address the problem, in the present embodiment, the velocity correction coefficient k3 during the compaction work in the case in which the boom rod pressure is equal to or higher than P1 is set to be smaller than that in the case in which the boom rod pressure is lower than P1. Changing the velocity correction coefficient in this way makes it possible to prevent the travel structure 2 from floating from the ground due to the excessive compaction force during the leveling compaction work.

It is noted that the problem of floating of the travel structure 2 occurs during the leveling compaction work by the arm operation. Owing to this, a configuration of setting to be smaller the velocity correction coefficient k3 in the case in which the boom rod pressure is equal to or higher than P1 may be limited to the second region (that is, when D3≤D≤0), and of using the same velocity correction coefficient k2 as that in Embodiment 1 in the other regions may be adopted.

Furthermore, while it has been described above that the velocity correction coefficient k3 during the compaction work is set to be smaller only in the case of the boom cylinder velocity equal to or higher than P1, the velocity correction coefficient k3 during the compaction work may be set to be gradually smaller in proportion to an increase in the boom rod pressure, that is, magnitudes of the limiting velocities of the cylinders may be set to be reduced in proportion to the increase in the boom rod pressure. In yet other words, a configuration of changing the magnitudes of the limiting velocities of the cylinders on the basis of the boom rod pressure during the compaction work may be adopted.

Moreover, while the velocity correction coefficient k3 during the compaction work at the high pressure is set to be smaller than k2 only in the range (D3≤D≤D1) where the velocity correction coefficient k2 during the compaction work is positive in the example of FIG. 14, the velocity correction coefficient k3 may be set to be smaller than k2 in the entire first region (D2≤D≤D1).

Embodiment 3

Figure 18:
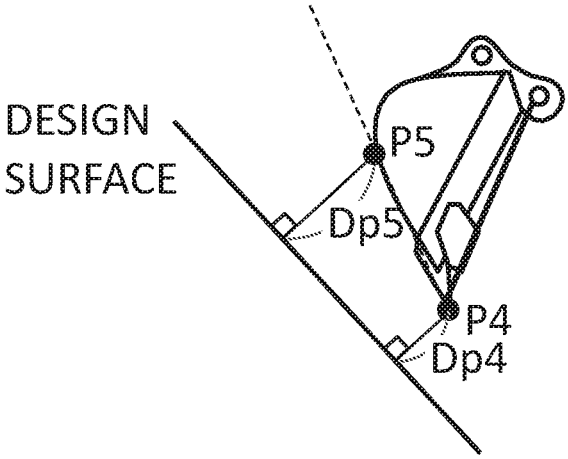
FIG. 18 is an explanatory diagram of a distance from a bucket tip end or a bucket rear end to the design surface.

Embodiment 3 of the present invention will be described. The present embodiment is characterized by determining whether a work phase is compaction work on the basis of the posture of the bucket 10 with respect to the design surface 60 in a case in which the operation device 24 instructs the work device 7 to approach the design surface 60. Specifically, in the present embodiment, a bucket rear end P5 (refer to FIG. 18) as well as the bucket tip end P4 is used as a control point, and the controller 25 computes distances Dp4 and Dp5 (refer to FIG. 18) between these two control points P4 and P5 and the design surface 60, determines that the work phase is compaction work in a case in which the distance Dp4 is equal to or greater than the distance Dp5 (that is, the bucket rear end P5 is closer to the design surface 60 than the bucket tip end P4), and determines that the work phase is ordinary work (excavation work) in a case in which the distance Dp4 is smaller than the distance Dp5 (that is, the bucket tip end P4 is closer to the design surface 60 than the bucket rear end P5). The bucket rear end P5 is an end point of a generally flat part starting at the bucket tip end P4, and this generally flat part is often referred to as a bucket bottom surface. In other words, a tip end of the bucket bottom surface is the tip end P4 and a rear end of the bucket bottom surface is the rear end P5. Since hardware configurations are the same as those in Embodiment 1, description of the hardware configurations will be omitted and different respects will be mainly described herein.

Figure 17:
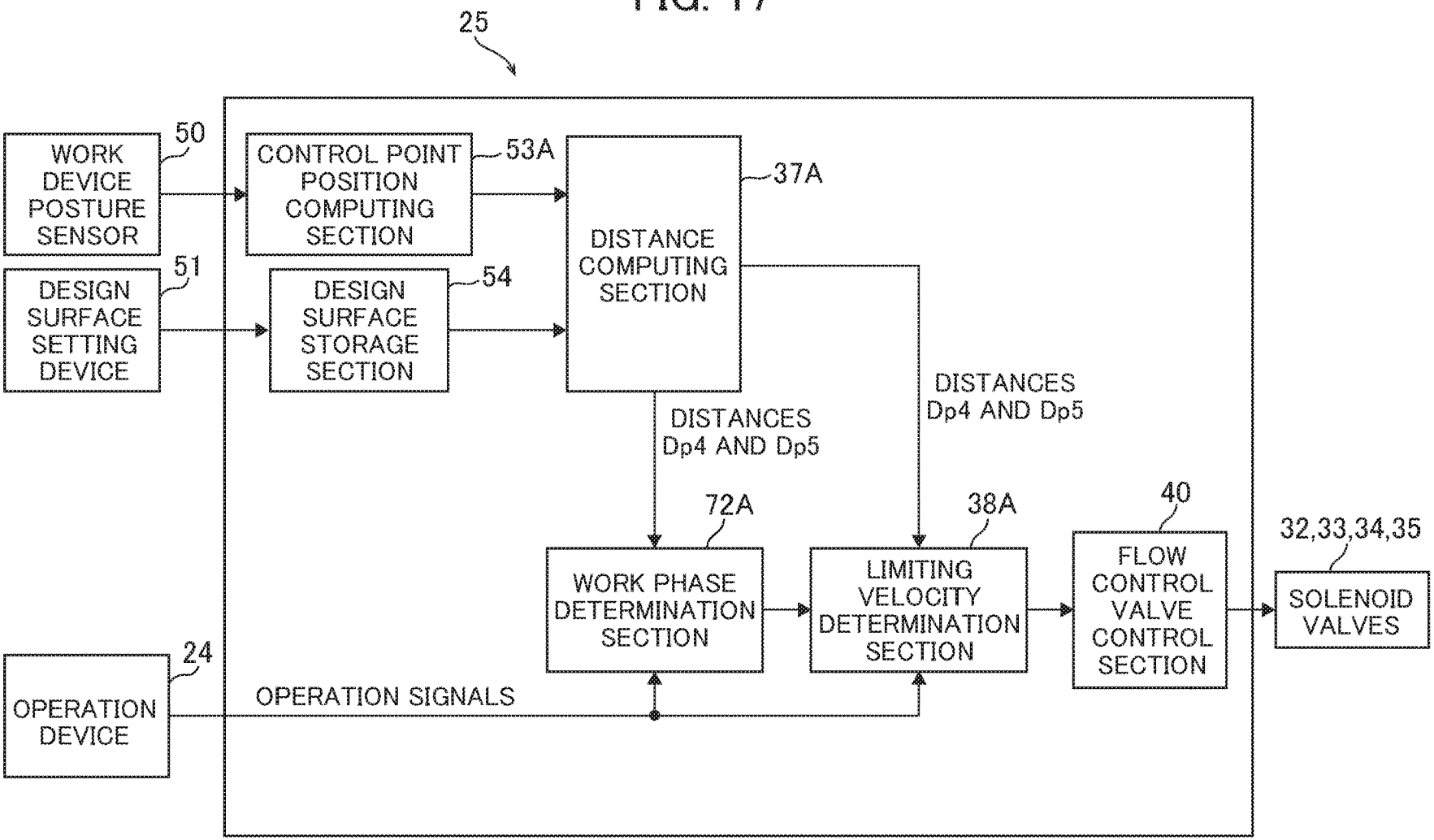
FIG. 17 is a functional block diagram of the controller 25 according to Embodiment 3.

FIG. 17 is a functional block diagram of the controller 25 according to Embodiment 3 of the present invention. The controller 25 of FIG. 17 is configured with a control point position computing section 53A, a distance computing section 37A, a work phase determination section 72A, and a limiting velocity determination section 38A.

The control point position computing section 53A computes positions of the bucket tip end P4 and the bucket rear end P5 (refer to FIG. 18) that are the control points in the global coordinate system in the present embodiment and the postures of the front members 8, 9, and 10 of the work device 7 in the global coordinate system. The control point position computing section 53A may perform computing on the basis of a well-known method and the method described above.

The distance computing section 37A computes the distances Dp4 and Dp5 (refer to FIG. 8) between the control points P4 and P5 of the work device 7 and the design surface 60 from position data about the two control points P4 and P5 of the work device 7 computed by the control point position computing section 53 and the position data about the design surface 60 acquired from the design surface storage section 54.

The work phase determination section 72A determines whether the work phase of the work device 7 is compaction work on the basis of the distances Dp4 and Dp5 computed by the distance computing section 37A and the operation signals output from the operation device 24. The work phase determination section 72A outputs the compaction work determination flag to the limiting velocity determination section 38A in response to the distances Dp4 and Dp5. The compaction work determination flag is one of conditions for determining by the work phase determination section 72 that the work phase is compaction work. 1 is output as the compaction work flag when the distance Dp4 is equal to or greater than the distance Dp5 (that is, the bucket rear end P5 is closer to the design surface 60 than the bucket tip end P4), and 0 is output as the compaction work flag when the distance Dp4 is smaller than the distance Dp5 (that is, the bucket tip end P4 is closer to the design surface 60 than the bucket rear end P5).

The work phase determination section 72A determines that the work phase of the work device 7 is compaction work when the compaction work flag described above is 1 and yet any of the operation signals is an operation signal instructing the work device 7 to approach the design surface 60.

The limiting velocity determination section 38A is a section that computes the target velocities (limiting velocities) of the hydraulic cylinders 11, 12, and 13 on the basis of the smaller distance out of the two distances Dp4 and Dp5 in such a manner that the action range of the work device 7 is limited onto or above the design surface 60 when the operation device 24 is operated. In other words, the limiting velocity determination section 38A calculates the target velocities with reference to the control point closer to the design surface 60 out of the two control points P4 and P5. In yet other words, the limiting velocity determination section 38A uses the distance Dp5 in a case in which 1 is input from the work phase determination section 72A as the compaction work flag, and uses the distance Dp4 in a case in which 0 is input as the compaction work flag.

First, the limiting velocity determination section 38 calculates the demanded velocity of the boom cylinder 11 (boom cylinder demanded velocity) from the voltage value (boom operation amount) input from the operation lever 24*a*, calculates the demanded velocity of the arm cylinder 12 from the voltage value (arm operation amount) input from the operation lever 24*b*, and calculates the demanded velocity of the bucket cylinder 13 from the voltage value (arm operation amount) input from the operation lever 24*c*. The limiting velocity determination section 38A calculates the velocity vector (demanded velocity vector) V0 of the work device 7 at the control point P4 or P5 from these three demanded velocities and the postures of the front members 8, 9, and 10 of the work device 7 computed by the control point position computing section 53. The limiting velocity determination section 38A then also calculates the velocity component V0*z* in the design surface vertical direction and the velocity component V0*x* in the design surface horizontal direction of the velocity vector V0.

Next, the limiting velocity determination section 38 computes the correction coefficients k1 and k2 determined in response to the smaller distance out of the two distances Dp4 and Dp5. A computing process is the same as that in Embodiment 1 except that the distance used to compute the correction coefficients k1 and k2 is the smaller distance out of the two distances Dp4 and Dp5.

Next, the limiting velocity determination section 38 calculates the velocity component V1*z* by multiplying the velocity component V0*z* of the velocity vector V0 in the design surface vertical direction by the correction coefficient k1 or k2 determined in response to the smaller distance out of the two distances Dp4 and Dp5. The limiting velocity determination section 38A calculates the resultant velocity vector (target velocity vector) V1 by combining the velocity component V1*z* with the velocity component V0*x* of the velocity vector V0 in the design surface horizontal direction, and computes the boom cylinder velocity, the arm cylinder velocity (Va1), and the bucket cylinder velocity at which the resultant velocity vector V1 can be generated as the target velocities (limiting velocities). At the time of computing these target velocities, the limiting velocity determination section 38A may use the postures of the front members 8, 9, and 10 of the work device 7 computed by the control point position computing section 53A.

Figure 19:
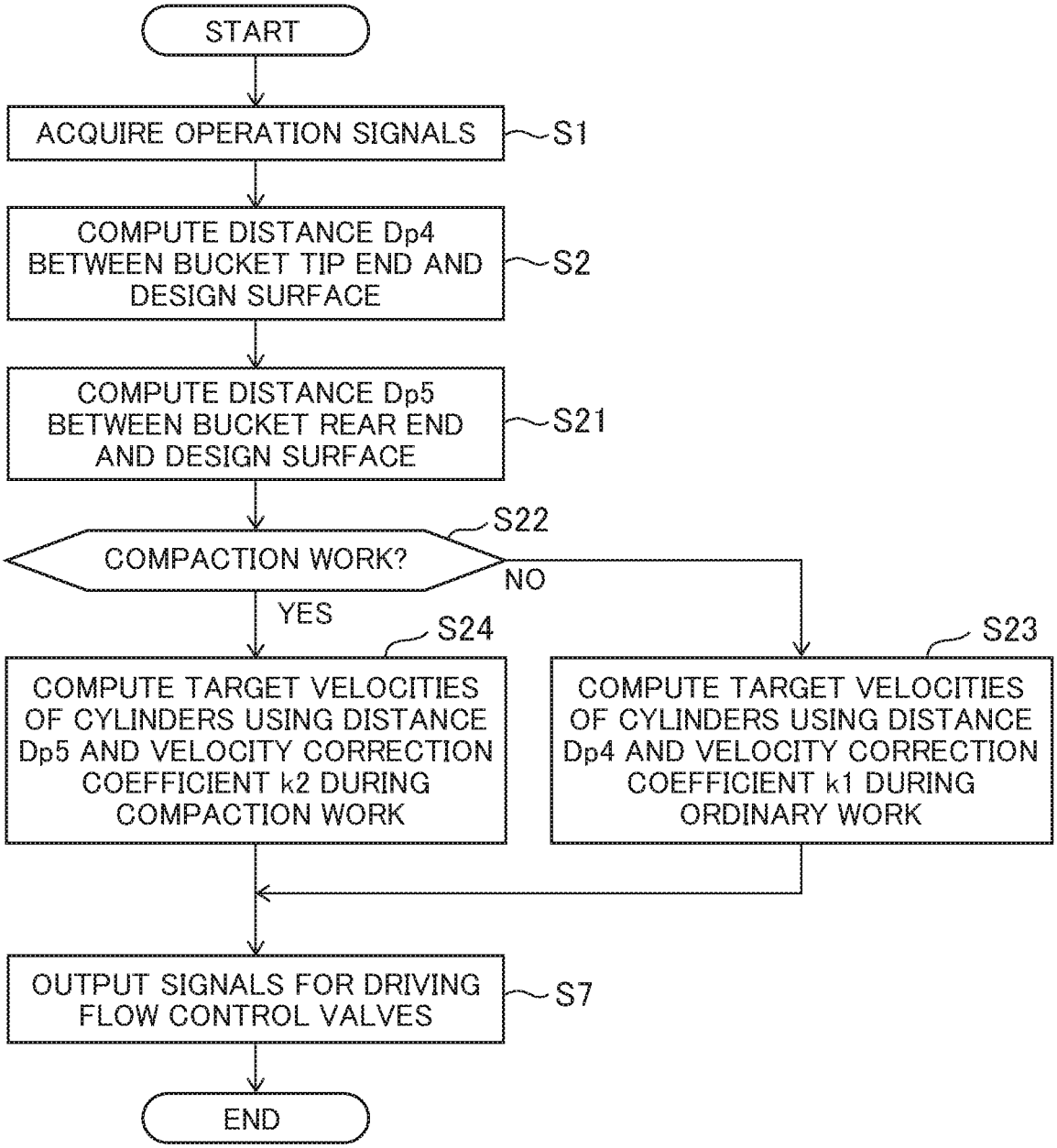
FIG. 19 is a flowchart representing a control flow performed by the controller 25 according to Embodiment 3.

FIG. 19 is a flowchart representing a control flow performed by the controller 25 according to the present embodiment. Procedures different from those in FIG. 12 will only be described herein.

In Procedure S2, the control point position computing section 53A computes first the position data about the bucket tip end P4 (first control point) in the global coordinate system on the basis of the information about the inclination angles θ1, θ2, θ3, and θ4 from the work device posture sensor 50, the position data, the posture data (angle data), and the azimuth data about the hydraulic excavator 1 computed from the navigation signals output from the GNSS antennas 21 and 22, the dimension data L1, L2, and L3 about the front members stored in advance, and the like. Next, the distance computing section 37A extracts and acquires the position data (target surface data) about design surfaces falling in the predetermined ranges with reference to the position data about the bucket tip end P4 in the global coordinate system computed by the control point position computing section 53A, from the design surface storage section 54. In addition, the distance computing section 37A sets the design surface located at the position closest to the bucket tip end P4 as the design surface 60 of an object to be controlled, that is, the design surface 60 for which the distance Dp4 is computed from among the design surfaces. The distance computing section 37A then computes the distance Dp4 on the basis of the position data about the bucket tip end P4 and the position data about the design surface 60, and the processing goes to Procedure S21.

In Procedure S21, the control point position computing section 53A computes position data about the bucket rear end P5 (second control point) in the global coordinate system on the basis of the data about the inclination angles θ1, θ2, θ3, and θ4, the position data, the posture data (angle data), and the azimuth data about the hydraulic excavator 1, the dimension data L1, L2, and L3 about the front members, and the like, similarly to Procedure S2. Next, the distance computing section 37A extracts and acquires the position data (target surface data) about design surfaces falling in the predetermined ranges with reference to the position data about the bucket rear end P5 computed by the control point position computing section 53A, from the design surface storage section 54. In addition, the distance computing section 37A sets the design surface located at the position closest to the bucket rear end P5 as the design surface 60 of the object to be controlled. The distance computing section 37A then computes the distance Dp5 on the basis of the position data about the bucket rear end P5 and the position data about the design surface 60, and the processing goes to Procedure S22.

In Procedure S22, the work phase determination section 72 determines whether a work phase of the work device 7 is compaction work on the basis of the distance Dp4 computed in Procedure S2, the distance Dp5 computed in Procedure S21, and any of the operation signals acquired in Procedure S1. In determining the work phase, the work phase determination section 72A determines first whether the distance Dp4 is equal to or greater than the distance Dp5, outputs 1 as the compaction work flag in the case in which the distance Dp4 is equal to or greater than the distance Dp5, and outputs 0 as the compaction work flag in the case in which the distance Dp4 is smaller than the distance Dp5. In the case of outputting 1 as the compaction work flag, the work phase determination section 72A determines whether any of the operation signals acquired in Procedure S1 is an operation signal for giving an instruction of boom lowering, arm dumping, or arm crowding. In a case in which the operation signal corresponds to any one of these actions, then the work phase determination section 72A determines that the current work phase is the compaction work, and the processing goes to Procedure S24. On the other hand, in the case in which the compaction work flag is 0 or in the case in which the compaction work determination flag is 1 but any of the operation signals is an operation signal corresponding to an action other than the three types of actions described above, then the work phase determination section 72A determines that the current work phase is the ordinary work, and the processing goes to Procedure S23.

In Procedure S23, the limiting velocity determination section 38A computes the velocity correction coefficient k1 during the ordinary work corresponding to the distance Dp4 computed in Procedure S2 by using the table (solid line) of FIG. 9. In addition, the limiting velocity determination section 38A computes the velocity vector V0 of the work device 7 on the bucket tip end P4 from the operation signals (voltage values) of the operation levers input from the operation device 24 and acquired in Procedure S1 and the postures of the front members 8, 9, and 10, and also computes the velocity component V0$z$ in the design surface vertical direction and the velocity component V0$x$ in the design surface horizontal direction of the velocity vector V0. Next, the limiting velocity determination section 38A calculates the velocity component V1$z$ by multiplying the velocity component V0$z$ in the design surface vertical direction by the previously computed velocity correction coefficient k1 during the ordinary work. The limiting velocity determination section 38A calculates the resultant velocity vector (target velocity vector) V1 by combining the velocity component V1$z$ with the velocity component V0$x$ of the velocity vector V0 in the design surface horizontal direction, and computes the boom cylinder velocity, the arm cylinder velocity, and the bucket cylinder velocity at which the resultant velocity vector V1 can be generated as the target velocities (limiting velocities).

In Procedure S24, the limiting velocity determination section 38A computes the velocity correction coefficient k2 during the compaction work corresponding to the distance Dp5 computed in Procedure S21 by using the table (broken line) of FIG. 9. In addition, the limiting velocity determination section 38A computes the velocity vector V0 of the work device 7 on the bucket rear end P5 from the operation signals (voltage values) of the operation levers input from the operation device 24 and acquired in Procedure S1 and the postures of the front members 8, 9, and 10, and also computes the velocity component V0$z$ in the design surface vertical direction and the velocity component V0$x$ in the design surface horizontal direction of the velocity vector V0. Next, the limiting velocity determination section 38A calculates the velocity component V1$z$ by multiplying the velocity component V0$z$ in the design surface vertical direction by the previously computed velocity correction coefficient k2 during the compaction work. The limiting velocity determination section 38A calculates the resultant velocity vector (target velocity vector) V1 by combining the velocity component V1$z$ with the velocity component V0$x$ of the velocity vector V0 in the design surface horizontal direction, and computes the boom cylinder velocity, the arm cylinder velocity, and the bucket cylinder velocity at which the resultant velocity vector V1 can be generated as the target velocities (limiting velocities).

According to the present embodiment configured as described so far, the work phase is determined to be the compaction work when the distance Dp4 is equal to or greater than the distance Dp5 and the arm operation signal or the boom lowering operation signal is output; thus, it is possible to accurately determine the compaction work, similarly to Embodiment 1. Furthermore, during the compaction work (bumping) by the boom lowering operation, setting the velocity correction coefficient of the work device 7 to be greater than that during the ordinary work when the distance Dp5 falls in the first region (D2≤D≤D1) makes it possible to favorably conduct the compaction work by the bumping. Moreover, during the compaction work (leveling compaction work) by the arm operation, setting the velocity correction coefficient k to the positive value when the distance Dp5 falls in the second region (D3≤D≤0) makes it possible to generate the velocities in the design surface vertical direction and favorably conduct the leveling compaction work.

Modification of Embodiment 1

A modification of Embodiment 1 will now be described. As depicted in FIGS. 3, 4, and 6, the machine control system 23 of the hydraulic excavator 1 described in Embodiment 1 may be further configured with an ON/OFF switch 80 that switches over between validity and invalidity of processing (limiting velocity change processing) for setting to be higher the limiting velocities when the work phase determination section 72 determines that the work phase is the compaction work, as described with reference to FIG. 12 and the like, than the limiting velocities when the work phase determination section 72 determines that the work phase is other than the compaction work. The ON/OFF switch 80 is a switch provided in, for example, a range in which the operator can reach the ON/OFF switch 80 while operating the hydraulic excavator 1 within the operation room 4, when the ON/OFF switch 80 is switched to ON, the limiting velocity change processing by the controller 25 is executable (valid), and when the ON/OFF switch 80 is switched to OFF, the limiting velocity change processing by the controller 25 is unexecutable (invalid).

Figure 20:
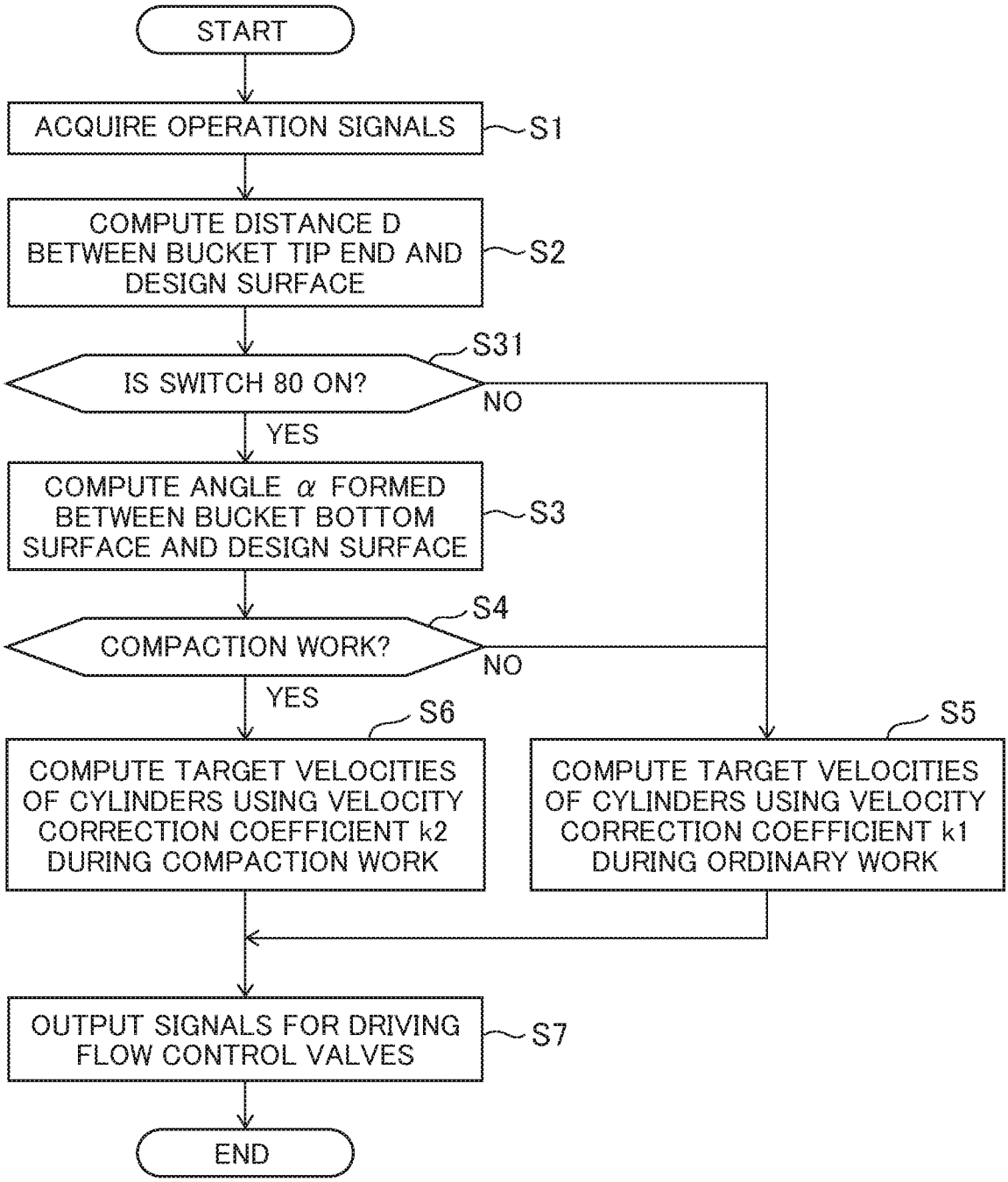
FIG. 20 is a flowchart representing a control flow performed by the controller 25 according to a modification of Embodiment 1.

FIG. 20 is a diagram representing a control flow of the controller 25 in a case of input of an input signal from the ON/OFF switch 80. Procedures different from those in FIG. 12 will only be described herein.

In Procedure S31, the controller 25 determines whether the ON/OFF switch 80 is ON on the basis of an ON/OFF signal input from the ON/OFF switch 80. In a case herein in which the ON/OFF switch 80 is ON, the processing goes to Procedure S3 and the processing in and after Procedure S3 is executed, similarly to the case of FIG. 12. On the other hand, in a case in which the ON/OFF switch 80 is OFF, the processing goes to Procedure S5 and the limiting velocity change processing is, therefore, not executed.

In a case of configuring the hydraulic excavator 1 in this way, it is possible to change whether to execute the limiting velocity change processing in response to an operator's desire. It is thereby possible to flexibly handle various work needs. While a case of mounting the ON/OFF switch 80 in Embodiment 1 has been described herein, it goes without saying that the limiting velocity change processing can be made ON/OFF in response to the operator's desire by mounting the ON/OFF switch 80 in the other embodiments.

<Others>

The present invention is not limited to the above embodiments but encompasses various modifications without departing from the spirit of the invention. For example, the present invention is not limited to the work machine configured with all the configurations described in the above embodiment but encompasses the work machine from which part of the configurations are deleted. Furthermore, a part of the configurations according to a certain embodiment can be added to or can be replaced with configurations according to the other embodiment.

While the velocity correction coefficient k2 is set to have a shape of connecting two straight lines having different inclinations before and after D=0 in the examples of FIGS. 9 and 14 described above, setting of the velocity correction coefficient k2 is not limited to that using the straight lines and can be variously changed. For example, the velocity correction coefficient k2 may be set to have a curved shape. The same thing is true for the other velocity correction coefficients k1 and k3.

In Embodiment 1, for configuring the work machine capable of both the bumping work and the leveling compaction work, the second region is designed to be contained in the first region by setting a lower end (D2) of the first region where the velocity correction coefficient k changes in response to the work phase to be smaller than a lower end (D3) of the second region where the velocity correction coefficient k2 is set to be positive in the range in which the velocity correction coefficient k1 is set to be negative in relation to setting of the velocity correction coefficients k1, k2, and k3. Alternatively, the first region and the second region can be provided individually. For example, the lower end of the first region can be made coincident with an upper end (O) of the second region so that there is no containment relationship between the first and second regions. Furthermore, in a case of configuring the work machine specialized in either the bumping work or the leveling compaction work, any one of the first region and the second region can be provided.

A part of or all of the configurations related to the controller 25 and functions, executed processing, and the like of the configurations described above may be realized by hardware (by designing logic for executing the functions, for example, by an integrated circuit, or the like). Furthermore, the configurations related to the controller 25 described above may be implemented as a program (software) for realizing the functions related to the configurations of the controller 25 by causing an arithmetic processor (for example, a CPU) to read and execute the program. Data related to the program can be stored in, for example, a semiconductor memory (such as a flash memory or an SSD), a magnetic storage device (such as a hard disk drive), or a recording medium (such as a magnetic disk or an optical disk).

DESCRIPTION OF REFERENCE CHARACTERS

1: Hydraulic excavator (work machine)
2: Travel structure
3: Swing structure
4: Operation room
5: Machine room
6: Counterweight
7: Work device
8: Boom
9: Arm
10: Bucket
11: Boom cylinder
12: Arm cylinder
13: Bucket cylinder
14: First hydraulic pump
15: Second hydraulic pump
16: Engine (prime mover)
17: Machine body inclination sensor
18: Boom inclination sensor
19: Arm inclination sensor
20: Bucket inclination sensor
21: First GNSS antenna
22: Second GNSS antenna
23: Machine control system
24: Operation device
25: Controller
26: Flow control valve device
27: Hydraulic circuit
28: First arm spool (first flow control valve)
29: Second arm spool (third flow control valve)
30: Bucket spool
31: Boom spool (second flow control valve)
32*a*, 32*b*: First arm spool drive solenoid valve
33*a*, 33*b*: Second arm spool drive solenoid valve
34*a*, 34*b*: Bucket spool drive solenoid valve
35*a*, 35*b*: Boom spool drive solenoid valve
36*a*, 36*b*: Hydraulic operating fluid tank
37: Distance computing section
38: Limiting velocity determination section
40: Flow control valve control section
50: Work device posture sensor

51: Design surface setting device
53: Control point position computing section
54: Design surface storage section
60: Design surface
61: Boom cylinder rod pressure sensor
71: Angle computing section
72: Work phase determination section

The invention claimed is:

1. A work machine comprising:

a work device having a boom, an arm, and a bucket;

a plurality of hydraulic actuators that drive the work device;

an operation device that outputs an operation signal in response to an operator's operation and that instructs the plurality of hydraulic actuators to be actuated; and a controller that limits a velocity at which the work device approaches a predetermined design surface to be equal to or lower than a predetermined limiting velocity in such a manner that the work device is located onto or above the design surface when the operation device is operated, wherein the controller determines whether a work phase of the work device is compaction work on a basis of a posture of the bucket with respect to the design surface in a case in which the operation device instructs the work device to approach the design surface, sets the limiting velocity, when determining that the work phase of the work device is the compaction work, to be higher than the limiting velocity when determining that the work phase of the work device is other than the compaction work, and determines that the work phase of the work device is the compaction work when an angle formed between a bottom surface of the bucket and the design surface is equal to or greater than a predetermined value and the operation signal is an operation instructing the work device to approach the design surface.

2. The work machine according to claim 1, wherein the controller sets the limiting velocity when the controller determines that the work phase of the work device is the compaction work and a tip end of the work device is located in a first region surrounded by a first boundary set above the design surface and a second boundary set onto or below the design surface, to be higher than the limiting velocity when the controller determines that the work phase of the work device is other than the compaction work.

3. The work machine according to claim 1, wherein while it is defined that a direction in which the work device penetrates into below the design surface is positive in relation to a velocity direction of the limiting velocity, the controller sets the direction of the limiting velocity to be positive when the work device is located in a second region surrounded by a second boundary set below the design surface and a third boundary set below the design surface in a case in which the controller determines that the work phase of the work device is the compaction work when the operation signal is an operation signal for giving an instruction of any one of arm dumping and arm crowding.

4. The work machine according to claim 1, wherein the plurality of hydraulic actuators include a boom cylinder that drives the boom, and the controller changes a magnitude of the limiting velocity on a basis of a pressure of a rod side of the boom cylinder in a case of determining that the work phase of the work device is the compaction work.

5. The work machine according to claim 1, wherein the plurality of hydraulic actuators include a boom cylinder that drives the boom, and the controller reduces a magnitude of the limiting velocity in response to an increase in a pressure of a rod side of the boom cylinder in a case of determining that the work phase of the work device is the compaction work.

6. The work machine according to claim 1, wherein the plurality of hydraulic actuators include a boom cylinder that drives the boom, and while it is defined that a direction in which the work device penetrates into below the design surface is positive in relation to a velocity direction of the limiting velocity, the controller sets the direction of the limiting velocity to be positive and changes a magnitude of the limiting velocity on a basis of a pressure of a rod side of the boom cylinder when a tip end of the work device is located in a second region surrounded by a second boundary set below the design surface and a third boundary set below the design surface in a case in which the controller determines that the work phase of the work device is the compaction work when the operation signal is an operation signal for giving an instruction of any one of arm dumping and arm crowding.

7. The work machine according to claim 1, wherein an angle formed between a bottom surface of the bucket and the design surface is a value obtained by subtracting an angle formed between the design surface and a reference plane from an angle formed between the bottom surface of the bucket and the reference plane, and an angle counterclockwise from the reference plane is defined as being positive.

8. The work machine according to claim 1, further comprising:

a switch that switches over between validity and invalidity of processing for setting the limiting velocity when it is determined that the work phase of the work device is the compaction work, to be higher than the limiting velocity when the work phase determination section determines that the work phase is other than the compaction work.

9. A work machine, comprising:

a work device having a boom, an arm, and a bucket;

a plurality of hydraulic actuators that drive the work device;

an operation device that outputs an operation signal in response to an operator's operation and that instructs the plurality of hydraulic actuators to be actuated; and a controller that limits a velocity at which the work device approaches a predetermined design surface to be equal to or lower than a predetermined limiting velocity in such a manner that the work device is located onto or above the design surface when the operation device is operated, wherein the controller determines whether a work phase of the work device is compaction work on a basis of a posture of the bucket with respect to the design surface in a case in which the operation device instructs the work device to approach the design surface, sets the limiting velocity, when determining that the work phase of the work device is the compaction work, to be higher than the limiting velocity when determining that the work phase of the work device is other than the compaction, and determines that the work phase of the work device is the compaction work when a rear end of a bottom surface of the bucket is closer to the design surface than a tip end of the bottom surface of the bucket and the operation signal is an operation signal instructing the work device to approach the design surface.

10. A work machine, comprising:

a work device having a boom, an arm, and a bucket;

a plurality of hydraulic actuators that drive the work device;

an operation device that outputs an operation signal in response to an operator's operation and that instructs the plurality of hydraulic actuators to be actuated; and a controller that limits a velocity at which the work device approaches a predetermined design surface to be equal to or lower than a predetermined limiting velocity in such a manner that the work device is located onto or above the design surface when the operation device is operated, wherein the controller determines whether a work phase of the work device is compaction work on a basis of a posture of the bucket with respect to the design surface in a case in which the operation device instructs the work device to approach the design surface, sets the limiting velocity, when determining that the work phase of the work device is the compaction work, to be higher than the limiting velocity when determining that the work phase of the work device is other than the compaction work, and determines that the work phase of the work device is the compaction work when an angle formed between a bottom surface of the bucket and the design surface is equal to or greater than a predetermined value and the operation signal is an operation signal for giving an instruction of any one of boom lowering, arm dumping, and arm crowding.

* * * * *